US009452459B2

(12) United States Patent
Daimaru et al.

(10) Patent No.: US 9,452,459 B2
(45) Date of Patent: Sep. 27, 2016

(54) METHOD FOR MANUFACTURING SHAPED STEEL THE CROSS-SECTIONAL SHAPE OF WHICH CHANGES IN THE LONGITUDINAL DIRECTION, AND ROLL FORMING DEVICE

(71) Applicant: NIPPON STEEL & SUMITOMO METAL CORPORATION, Tokyo (JP)

(72) Inventors: Seiichi Daimaru, Tokyo (JP); Masahiro Kubo, Tokyo (JP); Masaaki Mizumura, Tokyo (JP); Koichi Sato, Tokyo (JP); Satoshi Shirakami, Tokyo (JP); Yasushi Yamamoto, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/425,996

(22) PCT Filed: Sep. 24, 2012

(86) PCT No.: PCT/JP2012/074443
§ 371 (c)(1),
(2) Date: Mar. 4, 2015

(87) PCT Pub. No.: WO2014/045449
PCT Pub. Date: Mar. 27, 2014

(65) Prior Publication Data

US 2015/0251234 A1 Sep. 10, 2015

(51) Int. Cl.
*B21B 27/02* (2006.01)
*B21D 5/08* (2006.01)
(Continued)

(52) U.S. Cl.
CPC ..... *B21B 27/028* (2013.01); *B21B 1/28* (2013.01); *B21B 35/00* (2013.01); *B21B 39/02* (2013.01); *B21D 5/083* (2013.01); *B21B 1/095* (2013.01)

(58) Field of Classification Search
CPC ..... B21D 5/08; B21D 5/083; B21B 27/021; B21B 27/028; B21B 1/095; B21B 1/28; B21B 1/38; B21B 27/02; B21H 8/02
See application file for complete search history.

(56) References Cited

U.S. PATENT DOCUMENTS 4,317,350 A 3/1982 Sivachenko et al.
2009/0113974 A1 5/2009 Ingvarsson

FOREIGN PATENT DOCUMENTS

JP 57-206522 A 12/1982
JP 59-27722 A 2/1984
(Continued)

OTHER PUBLICATIONS

English translation of JP-59-179228-A, published Oct. 11, 1984.
(Continued)

*Primary Examiner* — Debra Sullivan
(74) *Attorney, Agent, or Firm* — Birch, Stewart, Kolasch & Birch, LLP

(57) ABSTRACT

A roll forming device, for roll forming for the purpose of manufacturing shaped steel the cross-sectional shape of which varies in the longitudinal direction, is equipped with: first die rolls having an annular ridge part the cross-sectional shape of which varies in the circumferential direction; second die rolls having an annular groove part the cross-sectional shape of which varies in the circumferential direction; and a drive device for the first die rolls and the second die rolls. A gap is provided at the side surfaces of the annular ridge part of the first die rolls, across the entire circumference in the circumferential direction, such that the gap with respect to the side surfaces of the annual groove parts of the second die rolls widens inward in the radial direction.

20 Claims, 27 Drawing Sheets

(51) Int. Cl.

| | |
|---|---|
| ***B21B 1/28*** | (2006.01) |
| ***B21B 35/00*** | (2006.01) |
| ***B21B 39/02*** | (2006.01) |
| *B21B 1/095* | (2006.01) |

(56) References Cited

FOREIGN PATENT DOCUMENTS

| | | | |
|---|---|---|---|
| JP | 59-179228 | A | 10/1984 |
| JP | 63-295019 | A | 12/1988 |
| JP | 5-329555 | A | 12/1993 |
| JP | 6-226356 | A | 8/1994 |
| JP | 7-88560 | A | 4/1995 |
| JP | 7-89353 | A | 4/1995 |
| JP | 10-34244 | A | 2/1998 |
| JP | 10-314848 | A | 12/1998 |
| JP | 2008-221289 | A | 9/2008 |
| JP | 2009-500180 | A | 1/2009 |

OTHER PUBLICATIONS

Taiwanese Office Action and Search Report, issued Feb. 4, 2015, for Taiwanese Application No. 101135599.

International Search Report, mailed Dec. 11, 2012, issued in PCT/JP2012/074443.

AMOUNT OF RELIEF $x = a \cdot H \cdot \tan\theta$ $\alpha$ IS SHAPE COEFFICIENT
(AFFECTED BY ROLL ROTATION RADIUS, etc.)

FIG. 13C

MINIMUM CLEARLANCE OF TOP AND BOTTOM ROLLS

| AMOUNT OF RELIEF | 10TH STEP | NINTH STEP | EIGHTH STEP | SEVENTH STEP | SIXTH STEP |
|---|---|---|---|---|---|
| 0mm | 0 | 0.639 | 0.894 | 0.98 | 0.999 |
| 0.1mm | 0 | 0.728 | 0.985 | 1 | 1 |
| 0.2mm | 0.052 | 0.817 | 1 | 1 | 1 |
| 0.3mm | 0.134 | 0.906 | 1 | 1 | 1 |
| 0.4mm | 0.216 | 0.995 | 1 | 1 | 1 |
| 0.5mm | 0.298 | 1 | 1 | 1 | 1 |
| 0.6mm | 0.379 | 1 | 1 | 1 | 1 |
| 0.7mm | 0.461 | 1 | 1 | 1 | 1 |
| 0.8mm | 0.542 | 1 | 1 | 1 | 1 |
| 0.9mm | 0.624 | 1 | 1 | 1 | 1 |
| 1.0mm | 0.705 | 1 | 1 | 1 | 1 |
| 1.1mm | 0.786 | 1 | 1 | 1 | 1 |
| 1.2mm | 0.867 | 1 | 1 | 1 | 1 |
| 1.3mm | 0.948 | 1 | 1 | 1 | 1 |
| 1.4mm | 1 | 1 | 1 | 1 | 1 |

AMOUNT OF RELIEF $x = a \cdot H \cdot \tan\theta$ $\alpha$ IS SHAPE COEFFICIENT
(AFFECTED BY ROLL ROTATION RADIUS, etc.)

FIG. 16C

MINIMUM CLEARLANCE OF TOP AND BOTTOM ROLLS

| AMOUNT OF RELIEF | 10TH STEP | NINTH STEP | EIGHTH STEP | SEVENTH STEP | SIXTH STEP | FIFTH STEP | FOURTH STEP | THIRD STEP | SECOND STEP | FIRST STEP |
|---|---|---|---|---|---|---|---|---|---|---|
| 0mm | 0 | 0.396 | 0.642 | 0.795 | 0.89 | 0.947 | 0.978 | 0.993 | 0.999 | 1 |
| 0.1mm | 0.038 | 0.484 | 0.733 | 0.888 | 0.985 | 1.004 | 1.003 | 1.002 | 1.001 | 1.001 |
| 0.2mm | 0.119 | 0.572 | 0.824 | 0.981 | 1.009 | 1.007 | 1.006 | 1.004 | 1.003 | 1.001 |
| 0.3mm | 0.2 | 0.66 | 0.915 | 1.015 | 1.013 | 1.011 | 1.008 | 1.006 | 1.004 | 1.002 |
| 0.4mm | 0.28 | 0.748 | 1.006 | 1.021 | 1.017 | 1.014 | 1.011 | 1.008 | 1.006 | 1.003 |
| 0.5mm | 0.361 | 0.836 | 1.03 | 1.026 | 1.022 | 1.018 | 1.014 | 1.01 | 1.007 | 1.003 |
| 0.6mm | 0.442 | 0.924 | 1.036 | 1.031 | 1.026 | 1.021 | 1.017 | 1.013 | 1.008 | 1.004 |
| 0.7mm | 0.523 | 1.011 | 1.042 | 1.036 | 1.031 | 1.025 | 1.02 | 1.015 | 1.01 | 1.005 |
| 0.8mm | 0.603 | 1.055 | 1.048 | 1.041 | 1.035 | 1.029 | 1.023 | 1.017 | 1.011 | 1.005 |
| 0.9mm | 0.684 | 1.062 | 1.054 | 1.047 | 1.039 | 1.032 | 1.025 | 1.019 | 1.012 | 1.006 |
| 1.0mm | 0.764 | 1.069 | 1.06 | 1.052 | 1.044 | 1.036 | 1.028 | 1.021 | 1.014 | 1.007 |
| 1.1mm | 0.845 | 1.076 | 1.067 | 1.057 | 1.048 | 1.039 | 1.031 | 1.023 | 1.015 | 1.008 |
| 1.2mm | 0.925 | 1.083 | 1.073 | 1.063 | 1.053 | 1.043 | 1.034 | 1.025 | 1.017 | 1.008 |
| 1.3mm | 1.005 | 1.091 | 1.079 | 1.068 | 1.057 | 1.047 | 1.037 | 1.027 | 1.018 | 1.009 |

METHOD FOR MANUFACTURING SHAPED STEEL THE CROSS-SECTIONAL SHAPE OF WHICH CHANGES IN THE LONGITUDINAL DIRECTION, AND ROLL FORMING DEVICE

TECHNICAL FIELD

The present invention relates to a method and apparatus for roll forming for producing a shaped steel which varies in cross-sectional shape in the longitudinal direction.

BACKGROUND ART

As a method of producing a hat-shaped steel, which is one type of shaped steel, press forming using a punch and die is widely known. In bending into a hat shape by press forming, the problem of springback, that is, the sheet material trying to return to its original state due to the reaction force when the press pressure is removed, easily arises, and therefore in the past, countermeasures for suppressing springback have been studied.

In this regard, in recent years, use of high tensile steel has been expanding. As one example, in the automobile industry, it is believed that reduction of the weight of the vehicle body will lead to reduction of the amount of emission of $CO_2$ and therefore high tensile steel is being proactively used for the vehicle body material. For this reason, on the production floor of shaped steels, the problem of the springback due to the high strength characteristics of steel materials has been surfacing. Furthermore, in recent years, high tensile steel which has an over 980 MPa tensile strength has also been being produced. With general press forming, it is difficult to produce a hat-shaped steel as designed from such high tensile steel.

As another method of producing a shaped steel, the roll forming method is known. Roll forming is, for example, a continuous bending process which runs a strip, which is taken out from a coil, through roll units provided at a plurality of successively arranged stations. Roll forming is, in particular, suitable for forming H-beams, L-beams, and other steel products and pipes and other long products with constant cross-sectional shapes in the longitudinal direction. On the other hand, roll forming, unlike press forming (drawing), is not suited for forming a shaped steel which varies in cross-sectional shape in the longitudinal direction.

PLTs 1 to 3 disclose the art of roll forming to produce a shaped steel which varies in cross-sectional shape in the longitudinal direction by variable control of the roll widths of split rolls. However, the roll forming process and apparatus disclosed in PLTs 1 to 3 have the problem of a complicated structure and method of control of the apparatus. For this reason, it is difficult to convert existing facilities for use for working the inventions of PLTs 1 to 3. Introduction of new facilities is necessary, and therefore the cost becomes high.

Further, if, as in the inventions of PLTs 1 and 3, broadening the roll widths of the split rolls during roll forming, there are the problems that only the corner parts at the front sides of the rolls will linearly contact the steel sheet material and, in high tensile steel or other materials, stiffness of a mill is insufficient, and therefore it is not appropriate for mass production.

CITATIONS LIST

Patent Literature

PLT 1: Japanese Patent Publication No. H10-314848 A
PLT 2: Japanese Patent Publication No. H7-88560 A
PLT 3: Japanese Patent Publication No. 2009-500180A

SUMMARY OF INVENTION

Technical Problem

The present invention was made to solve the above problem and has as its object to provide art which enables production of a shaped steel which varies in cross-sectional shape in the longitudinal direction by simple roll forming without the need for complicated control and apparatuses such as in the prior art.

Further, another object of the present invention is to provide art which enables suppression of insufficiency in stiffness of a mill when using, for example, high tensile steel, in the case of producing a shaped steel, which varies in cross-sectional shape in the longitudinal direction, by roll forming.

Solution to Problem

To solve the above-mentioned problem, according to the present invention, there is provided a method of producing a shaped steel which varies in cross-sectional shape in the longitudinal direction from a sheet by roll forming, comprising: a step of preparing a first rolling die which has a rotation shaft and an annular ridge part which varies in cross-sectional shape in a circumferential direction which is centered about the rotation shaft; a step of arranging the first rolling die so that the rotation shaft of the first rolling die becomes perpendicular to a sheet feed direction; a step of preparing a second rolling die which has a rotation shaft and an annular groove part which varies in cross-sectional shape in a circumferential direction which is centered about the rotation shaft; a step of arranging the second rolling die so that a gap which is equal to a thickness of the sheet is formed between the first rolling die and second rolling die and the annular ridge part of the first rolling die and the annular groove part of the second rolling die engage; a step of making the first rolling die and the second rolling die rotate synchronized; and a step of feeding a sheet between the first rolling die and second rolling die, wherein the side surfaces of the annular ridge part of the first rolling die are provided with relief so that the gap with respect to side surfaces of the annular groove part of the second rolling die broadens inward in the radial direction over an entire of the circumference.

Furthermore, the present invention has as its gist a roll forming apparatus for roll forming use for producing a shaped steel which varies in cross-sectional shape in the longitudinal direction from a sheet, comprising: a first rolling die which has a rotation shaft and an annular ridge part which varies in cross-sectional shape in a circumferential direction which is centered about the rotation shaft, the first rolling die arranged so that the shaft of the first rolling die becomes perpendicular to a sheet feed direction; a second rolling die which has a rotation shaft and an annular groove part which varies in cross-sectional shape in a circumferential direction which is centered about the rotation shaft, the second rolling die arranged so that the rotation shaft of the second rolling die becomes parallel to the rotation shaft of the first rolling die; and a drive device which synchronizes and rotationally drives the first rolling die and the second rolling die, the first rolling die and second rolling die being arranged relatively so that a gap which is equal to a thickness of the sheet is formed between the two and the annular ridge part of the first rolling die and the annular groove part of the second rolling die engage, wherein the side surfaces of the annular ridge part of the first rolling die are provided with relief so that the gap with respect to side surfaces of the annular groove part of the second rolling die broadens inward in the radial direction over an entire of the circumference.

Advantageous Effects of Invention

According to the present invention, by using a first rolling die having an annular ridge part which varies in cross-sectional shape in the circumferential direction and a second rolling die having an annular groove part which receives the annular ridge part of the first rolling die while maintaining a gap with the annular ridge part of the amount of thickness of the shaped steel, by simple control for making at least the first and second rolling dies rotate synchronized, a shaped steel with a cross-sectional shape which varies in the longitudinal direction can be produced. Accordingly, complicated control such as variable control of the roll widths of split rolls for broadening the width of the cross-section becomes unnecessary. Further, it is possible to realize the rolling forming apparatus of the present invention by changing the rolls of existing roll forming apparatuses to the first and second rolling dies.

In addition, according to the present invention, by using the first and second rolling dies which have the above-mentioned roll barrel parts, even if the cross-sectional shape varies in the longitudinal direction, shaping is possible in the state where the roll barrel parts and material contact sufficiently on surface to each other, and therefore it is possible to suppress insufficiency in stiffness of a mill when using, for example, high tensile steel.

BRIEF DESCRIPTION OF DRAWINGS

FIG. 13C is a table which shows minimum gaps between the top and bottom rolls.

FIG. 16C is a table which shows minimum gaps between the top and bottom rolls.

DESCRIPTION OF EMBODIMENTS

Below, a method of production of a shaped steel which varies in cross-sectional shape in the longitudinal direction and a roll forming apparatus for the same according to preferable embodiments of the present invention will be explained in detail, while referring to the attached drawings. However, the embodiments explained below shall not cause the present invention to be interpreted limited in technical scope in any way.

First Embodiment

Figure 1A:
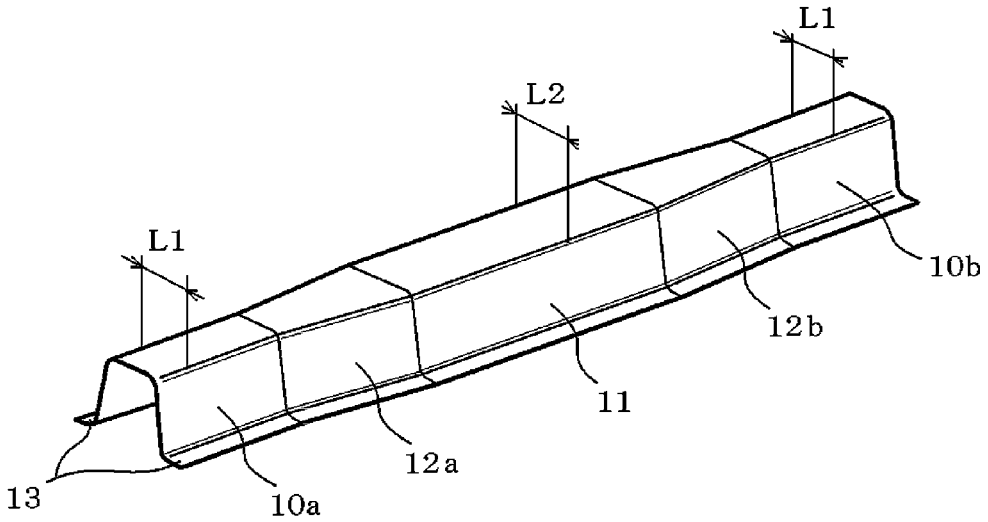
FIG. 1A is a perspective view of a hat-shaped steel which varies in cross-sectional shape in the longitudinal direction, as seen from above.
Figure 1B:
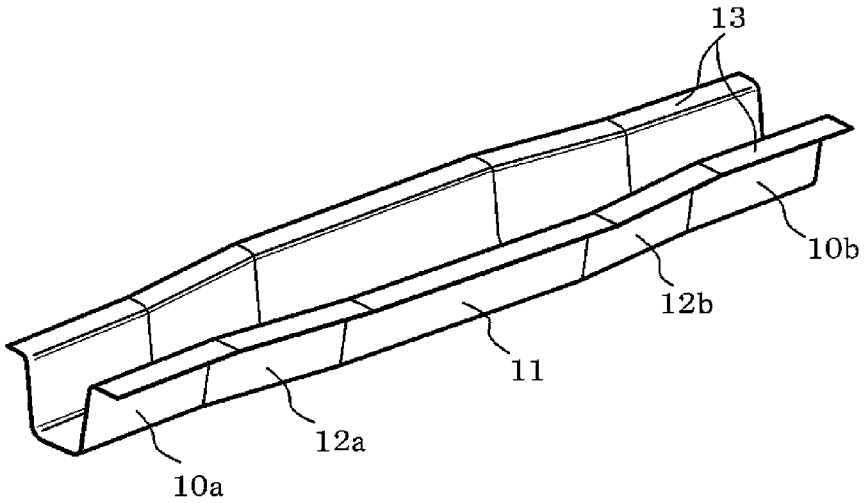
FIG. 1B is a perspective view of a hat-shaped steel which varies in cross-sectional shape in the longitudinal direction, as seen from below.

First, the shaped steel produced in the present embodiment will be explained. The shaped steel which is shown in FIGS. 1A and 1B is one example of a hat-shaped steel of a saddle shape which varies in cross-sectional shape in the longitudinal direction (for example, the metal stock axis direction). FIG. 1A is a perspective view of the hat-shaped steel seen from the upper side, while FIG. 1B is a perspective view seen from the lower side. The hat-shaped steel 1 comprises a top wall, side walls which extend along the two side edge parts of the top wall, and flanges which extend along the edge parts at the opposite sides of the side walls, and has a cross-section vertical to the longitudinal direction of the hat-shaped steel 1 (lateral cross-section) which is substantially hat shaped.

The hat-shaped steel 1 further has ˆportions 10*a*, 10*b* having top wall width of L1, a portion 11 having top wall width of L2 (>L1), and tapered transition portions 12*a* and 12*b* having expanding (or contracting) top wall width of L1 to L2. The hat-shaped steel 1 has hat-shape horizontal cross-sections with side walls which flare outward at the portions 10*a* to 12*b*. The side walls may have gradient angles which differ at the portions 10*a* to 10*b* or which are the same at the portions 10*a* to 10*b*. Further, the thickness of the steel shape can, for example, be set to various thicknesses according to the specifications, applications, etc. However, in the present embodiment, the different portions 10*a* to 12*b* are not individually shaped and joined by welding etc., but are integrally shaped from a single sheet or strip by roll forming. Therefore, the boundary lines between portions of FIG. 1 are lines for convenience of explanation and are not join lines or bend lines.

Furthermore, the flanges 13 formed at the opening part of the bottom surface side along the longitudinal direction are also obtained by bending the sheet or strip by roll forming. Further, the corner parts which formed by bending can, for example, have chamfered shapes or rounded shapes such as shown in FIG. 1.

The type and strength of the material are not particularly limited. All metal materials which can be bent can be covered. As examples of the metal material, there are carbon steel, alloy steel, nickel-chromium steel, nickel-chromium-molybdenum steel, chromium steel, chromium-molybdenum steel, manganese steel, and other steel materials. If based on strength, steel with tensile strengths of 340 MPa or less can be roughly classified as general steel and steel with higher strengths can be roughly classified as high tensile steel, but in the present embodiment, either can be applied. Furthermore, high tensile steel includes steel of for example the 590 MPa grade or 780 MPa grade. Currently, steel of the 980 MPa grade called "ultra high tensile steel" are being produced. Regarding ultra high tensile steel, sometimes bending into hat shapes becomes difficult with conventional press forming (drawing), but with the roll forming of the present embodiment, 980 MPa or more ultra high tensile steel can also be applied. Furthermore, as examples of materials other than steel materials, there are the poorly malleable materials including titanium, aluminum, or magnesium or their alloys.

Figure 2:
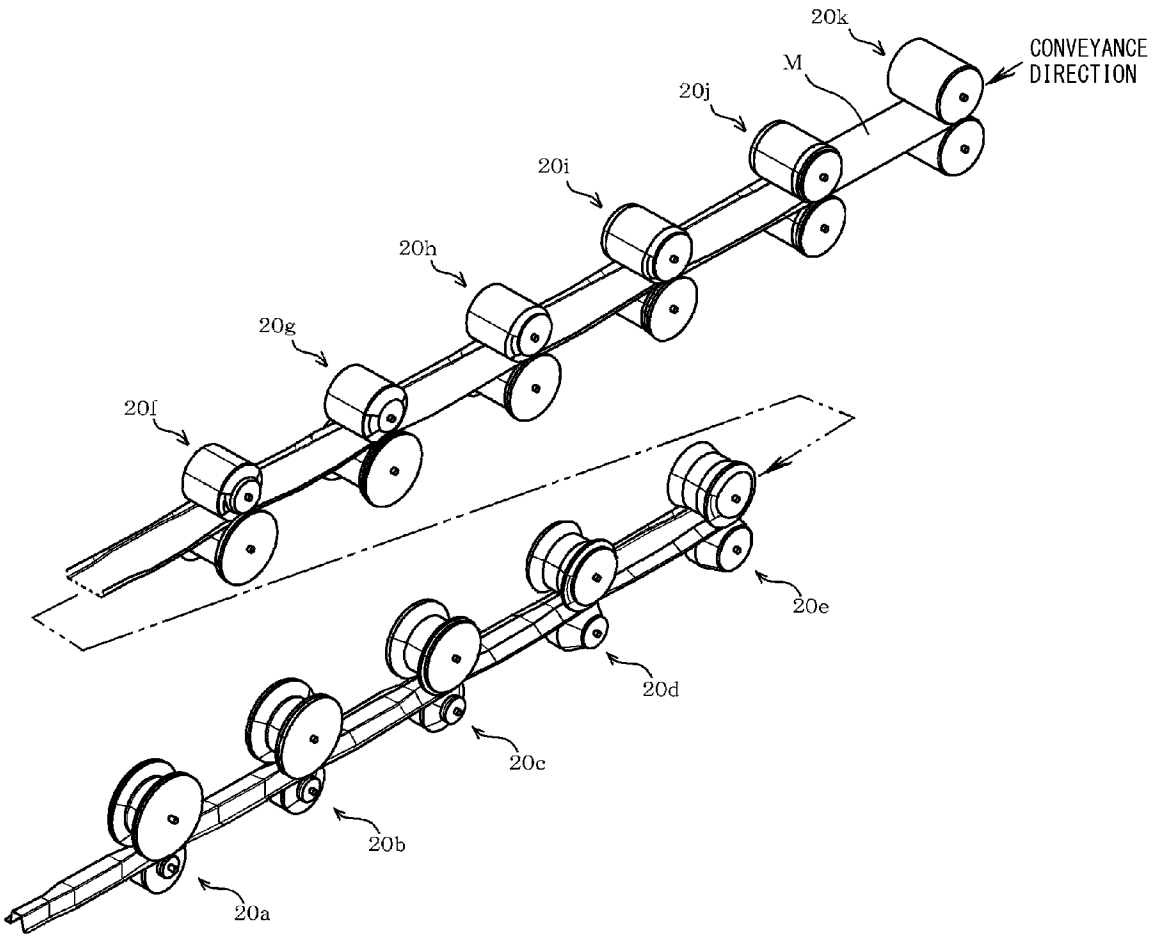
FIG. 2 is a schematic perspective view of a multistage roll forming apparatus according to a first embodiment of the present invention.

Next, the roll forming apparatus for producing a steel shape which varies in cross-sectional shape in the longitudinal direction will be explained. FIG. 2 shows a multistage roll forming apparatus 2 for producing the above-mentioned hat-shaped steel as one embodiment of a roll forming apparatus. The multistage roll forming apparatus 2 comprises, for example, a plurality of roll units 20*a* to 20*k* which are successively arranged in the sheet or strip feed direction. Due to this, a long sheet or strip M is conveyed from the upstream side roll unit 20*k* to the downstream side roll unit 20*a* while bending it in stages to obtain the final target product shape. The finally shaped sheet or strip M is successively cut into product units.

The rolling dies of the roll unit 20*a* of the downstream-most station (final station) (below, sometimes referred to as the "finishing rolls") are shaped corresponding to the target product shape. The rolling dies of the stations at the upstream side from the finishing rolls are designed so that intermediates which approach the final product shape in stages the further toward the downstream side are formed at the different stages. FIG. 2 shows one example of the rolling dies which form a final product from a sheet or strip M in 10 stages. At each of the entry station to the fifth station which perform the first half bending process, the roll units 20*j* to 20*f* have the dies which have the projecting shape roll barrel parts at the top side and the dies which have the recessed shape roll barrel parts at the bottom side.

On the other hand, at each of the fourth station to the 10th station which perform the second half bending process, the roll units 20*e* to 20*a* have the dies which have the annular ridge parts at the bottom side and the dies which have the annular groove parts at the top side. Further, the entry station (roll unit 20*k*: 0th station) to fifth station (roll unit 20*f*) are the first half process for forming the flanges 13 (flange bending) and the sixth station (roll unit 20*e*) to the final station or the 10th station (roll unit 20*a*) are the second half process for forming the top wall of the hat-shaped steel 1 (top wall bending).

The roll unit 20*k* of the entry station has rolling dies having plain cylindrical shape arranged at both the top and bottom. Further, the roll units 20*j* to 20*f* from the first station to the fifth station become gradually smaller in diameters in the directions toward the ends at both two end portions of the top rolls, while the two end portions of the roll barrel parts of the bottom rolls become gradually larger in diameter in the directions toward the ends. Further, the gradient angles of the two end portions of the dies become sharper in order from the first station to the fifth station. At the roll unit 20*f* of the fifth station, the two ends of the sheet or strip M are bent about 900, whereupon the flanges 13 are formed. The dies have, in the circumferential direction, parts of narrow widths and wide widths and parts of tapers of increasing/ decreasing width, at the centers of the roll barrel parts, so that flanges 13 of the portions 10*a* to 12 of the shaped steel are formed.

On the other hand, the roll units 20*e* to 20*a* from the sixth station to the final station have bottom rolls with annular ridge parts in which the center of the roll barrel parts are raised in projecting shapes and have top rolls with annular groove parts in which the center of the roll barrel parts are sunk in recessed shapes. Further, more specifically, the annular ridge parts of the bottom rolls and the annular groove parts of the top rolls comprises narrow width parts, wide width parts, and tapered parts with increasing width/decreasing width, arranged in the circumferential direction, so that the top walls of the portions 10*a* to 12 of the hat-shaped steel 1 are formed.

The gradient angles of the side surfaces of the annular ridge parts and annular groove parts of the rolls become sharper in the order from the sixth station to the final station. At the roll unit 20*a* of the final station, the side walls of the sheet or strip M are bent about 900 whereby the top wall of the hat is formed. However, the configuration of the rolling dies which is shown in FIG. 2 is one example. The number of units arranged can be suitably changed. Further, the rolling dies which are arranged at the upstream side of the finishing rolls can be further suitably changed in shapes.

Note that, in the present embodiment, the cross-sectional shape is not just increased in width. After the portion 11 where the width becomes maximum, portions 12*b* and 10*b* which are decreased in widths are formed by the rolls, and therefore the intervals between the roll units 20*a* to 20*k* are set to at least the lengths of the products.

Figure 3:
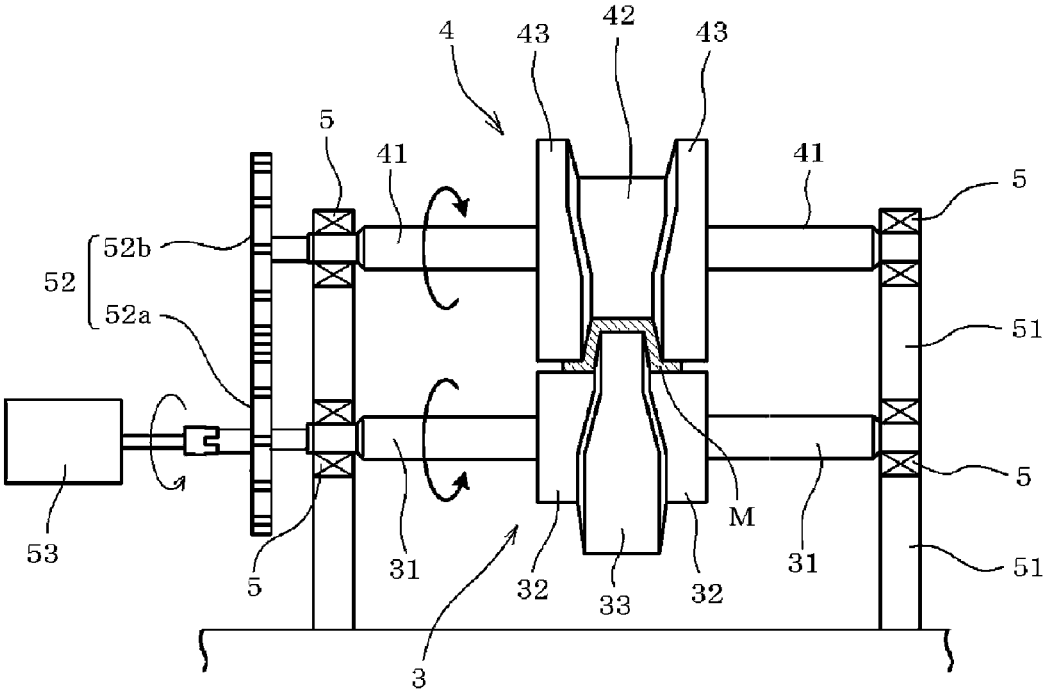
FIG. 3 is a vertical view of a roll unit of the multistage roll forming apparatus of FIG. 2.

Next, the configuration of the roll units 20*a* to 20*k* will be explained. FIG. 3 shows the overall structure of the roll unit 20*a* in which the finishing rolls are assembled. The roll unit 20*a* is provided with a first rolling die which has a rotation shaft 31 which extends in a sheet or strip feed direction, for example, the horizontal direction (below, referred to as a "bottom roll 3") and a second rolling die which has a rotation shaft 41 which is parallel to the shaft 31 of the first roll die 3 and faces the bottom roll 3 across a slight gap (below, referred to as a "top roll 4").

The shafts 31 and 41 of the rolls 3 and 4 are, for example, rotatably supported by ball bearings or other bearing mechanisms 5 at stands or other support members 51. The rolls 3 and 4 are supported to be able to be raised and lowered and can be adjustable in distance of separation of the rolls. Furthermore, it is also possible to use a hydraulic pressure cylinder or other pressing device to enable adjustment of the pressing forces of the top and bottom rolls 4 and 3.

The top and bottom rolls 4 and 3 are driven to rotate synchronized by a gear set 52. The gear set 52 comprises gears 52*a* and 52*b* which are coupled with the shafts 31 and 41 respectively and are engaged with each other. FIG. 3 shows, as one example of the gear set 52, the top and bottom gears 52*a* and 52*b* which are formed by spur gears. Further, at one end of the shaft 31 of the bottom roll 3, for example, a drive motor or other drive device 53 is connected. If this drive device 53 makes the bottom roll 3 rotate, the top roll 4 is driven to rotate through the gear set 52. At this time, for example, by setting the top and bottom gear ratios the same, the top and bottom rolls 4 and 3 rotate synchronously at the same peripheral speeds. That is, the gear set 52 is also the synchronized rotation mechanism of the top and bottom rolls 4 and 3.

The gear set 52 only need make the top and bottom rolls 4 and 3 rotate synchronously by the same peripheral speed. The gears need not be spur gears such as shown in FIG. 3 of course. Furthermore, it need not be configured to drive the top roll 4 through the gear set 52. Individual drive mechanisms may also be connected to the top and bottom rolls 4 and 3. It is also possible to use an inverter controllable drive motor to adjust the rotational speed.

Figure 4:
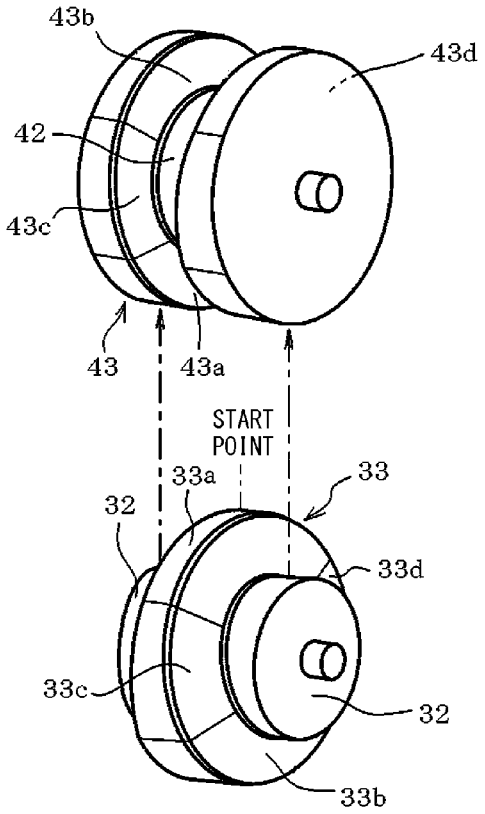
FIG. 4 is a disassembled perspective view of a pair of top and bottom rolling dies of the roll unit of FIG. 3.

The top and bottom rolls 4 and 3 which are arranged at the final station are shaped corresponding to the target product shape. Specifically, as shown in FIGS. 3 and 4, the bottom roll 3 has flank parts 32 which roll the top surfaces of the flanges 13 and an annular ridge part 33 which rises up at the center portion in the axial direction of the flank parts 32 from the outer surface in a projecting shape and rolls the inside part of the hat shape. The cross-sectional shape of the annular ridge part 33 exhibits a frustoconical shape which varies in the circumferential direction corresponding to the hat shape of the finished product.

That is, the annular ridge part 33 has a region 33*a* which is set in width of the outer circumferential surface to the first roll width, a region 33*b* which is set in width of the outer circumferential surface to the second roll width, and tapered regions (in the following explanation, sometimes called the "transition parts") 33*c* and 33*d* which are arranged between the regions 33*a* and 33*b* and vary in widths of the outer circumferential surfaces from the first roll width to the second roll width. The left and right side surfaces of the annular ridge part 33 form slanted surfaces which expand to the outward sides the further toward the shaft 31 side. Further, the width and height of the annular ridge part 33 and the gradient angle of the side surfaces are dimensions which correspond to the width and height and the gradient angle of the target hat shape. Furthermore, the corner parts at the outsides of the annular ridge part 33 and the corner parts at the insides of the flank parts 43 are rounded or are chamfered. Note that, FIG. 4, like FIG. 1, shows the borderlines of the regions 33*a*, 33*b*, 33*c*, and 33*d* for convenience of explanation.

The region 33*b* of the annular ridge part 33 forms the portion 11 of the width L2 of the hat-shaped steel 1, while the regions 33*c* and 33*d* form the tapered portions 12*a* and 12*b* of the hat-shaped steel 1. Therefore, the arc length of the region 33*b* is set to the length of the portion 11, while the arc lengths of the regions 33*c* and 33*d* are set to lengths of the portions 12*a* and 12*b*. On the other hand, the region 33*a* of the annular ridge part 33 forms both the portions 10*a* and 10*b* of the hat-shaped steel 1. Therefore, the arc length of the region 33*a* is set to a length corresponding to the sum of the lengths of the portions 10*a* and 10*b*. In this case, the intermediate point which equally divides the region 33*a* becomes the start point of the roll. However, when a continuous sheet or strip M for continuous forming is used and the finally shaped product is successively cut downstream of the apparatus, regions giving cutting margins may also be added to the regions 33*a*. In this case, a mark for indicating the cutting position (for example, small hole, projection, etc.) may also be formed at the surface of the sheet or strip M.

On the other hand, the top roll 4 is formed to face the roll barrel part of the bottom roll 3 across a gap of the amount of thickness of the hat-shaped steel 1. Therefore, the top roll 4 has an annular groove part 42 which rolls the outside bottom surface of the hat shape and flank parts 43 which are formed at the two sides of the annular groove part 42 and roll the outside surfaces of the hat shape and the bottom surfaces of the flanges 13. The inside surfaces of the annular groove part 42 are also formed to face the side surfaces of the annular barrel part 33 of the bottom roll 3 through a gap of the amount of thickness of the hat-shaped steel 1. Due to this, the annular groove part 42 of the top roll 4 varies in cross-sectional shape in the circumferential direction.

The side surfaces of the annular groove part 42 of the top roll 4, like the annular ridge part 33 of the bottom roll 3, are formed with the region 43*b* which forms the portion 11 of the hat-shaped steel 1, the regions 43*c* and 43*d* which form the tapered portions 12*a* and 12*b* respectively, and the region 43*a* which forms the portions 10*a* and 10*b*, in the circumferential direction. Furthermore, in the same way as the annular ridge part 33, the intermediate point which equally divides the region 43*a* forms the start point of the rolls, and therefore when assembling the top and bottom rolls 4 and 3 in the apparatus, the top and bottom rolls 4 and 3 are positioned in the rotation direction at the positions where their start points face each other (same phase).

If viewed in the shaft direction, the annular ridge part 33 of the bottom roll 3 and the flank part 43 of the top roll 4 have cylindrical surfaces with outer circumferential surfaces of the same diameters. Due to this, if making the top and bottom rolls 4 and 3 rotate by the same peripheral speeds, the relative phase of the top and bottom rolls 4 and 3 will not change. In the case of a pair of top and bottom rolls, so-called "slip" is liable to cause the relative phase of the turning top and bottom rolls 4 and 3 to change. If the rolls have cross-sectional shapes which are constant in the circumferential direction, "slip" does not become that much of a problem, but the top and bottom rolls 4 and 3 of the present embodiment have regions which vary in cross-sectional shape in the circumferential direction, and therefore if "slip" causes the top and bottom rolls 4 and 3 to become offset in phase, the finished product is liable to become off in thickness from the design value and the top and bottom rolls are liable to collide. Therefore, in the present embodiment, it is important to make the top and bottom rolls 4 and 3 turn without changing their relative phases. The gear 52 which forms the above-mentioned synchronized rotation mechanism also has the role of preventing the relative phase of the turning top and bottom rolls 4 and 3 from changing.

Note that, the top and bottom rolls 4 and 3 only have to be made from a material which is higher in rigidity than the sheet or strip M at the roll barrel parts. The material is not limited. Further, it is also possible to arrange the rolling die which has the annular ridge part at the top side and the rolling die which has the annular groove part at the bottom side.

FIG. 3 shows a roll unit 20*a* which including finishing rolls, but the other roll units 20*b* to 20*k* which are arranged upstream of the finishing rolls may be made the same in configuration as the roll unit 20*a* except for the shapes of the rolls being different. For this reason, detailed explanations of the other roll units 20*b* to 20*k* will be omitted.

The present invention is not limited to the following dimensions, but to further deepen understanding, an example of the dimensions of the different regions of the bottom roll 3 will be shown. First, the radius of the bottom roll 3 to the outer circumferential surface is 500 mm at the annular ridge part 33 and 450 mm at the flank parts 32. The difference of the two corresponds to the height of the hat shape. The width of the outer circumferential surface of the region 33*a* is 50 mm, while the arc length is 400 mm. Further, the width of the outer circumferential surface of the region 33*b* is 80 mm, while the arc length is 400 mm. Further, the portions 33*c* and 33*d* have arc lengths of 300 mm and expand in width or contract in width by a 15° gradient angle. The top roll 4 faces the bottom roll 3 through a gap of 2 mm.

Next, the method of using the multistage roll forming apparatus 2 to produce the hat-shaped steel 1 will be explained. First, the top and bottom rolls 4 and 3 of the roll units 20*a* to 20*k* are made to rotate at a predetermined speed and the sheet or strip M is fed to the roll unit 20*k* of the entry station. For example, as the steel sheet or strip M, it is possible to use steel sheet which is sent from an upstream rolling process or use a strip which is wound in a coil shape. At this time, the sheet or strip M is fed so that the length direction becomes perpendicular to the axial direction of the top and bottom rolls 4 and 3 and is roll formed in the length direction of the sheet or strip M. The sheet or strip M (intermediate) which is fed out from the roll unit 20*k* is conveyed by the rotational operation of the top and bottom rolls 4 and 3 to the roll unit 20*j* of the next station. Further, it is roll formed by this second stage roll unit 20*j* along the length direction and is further conveyed to the roll unit 20*i* of the next station.

Note that, when continuously roll forming the sheet or strip M, the roll units 20*a* to 20*k* of the different stations may be used to form it while applying back tension and/or forward tension. Further, they may form it by cold, warm, or hot roll forming.

Figure 5A:
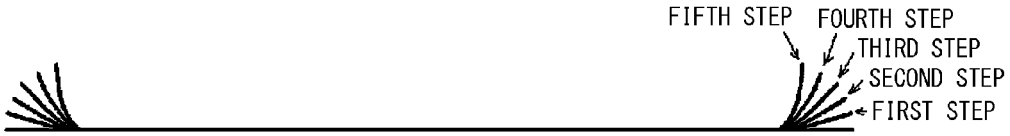
FIG. 5A is a view showing a bending process at different stages of the multistage roll forming apparatus of FIG. 2 and a view showing a step of forming flanges of a hat-shaped steel.
Figure 5B:
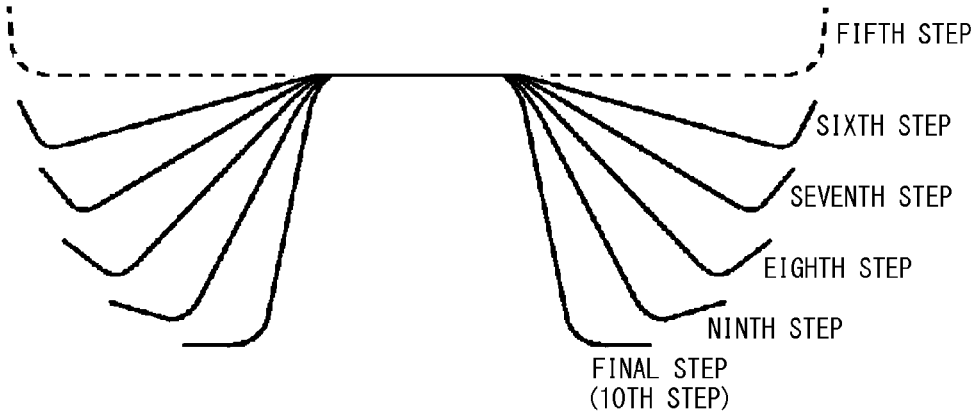
FIG. 5B is a view showing a bending process at different stages of the multistage roll forming apparatus of FIG. 2 and a view showing a step of forming a top wall of a hat-shaped steel.

FIGS. 5A and 5B show the state where the sheet or strip M is bent into a hat shape in stages at the 10 stages of the roll units 20*a* to 20*k*. FIG. 5A shows the state in which the flanges 13 are formed by using the roll units 20*k* to 20*a* at the first to fifth stations. FIG. 5B shows the state in which the top wall of the hat-shaped steel 1 is formed by using the roll units 20*e* to 30*a* at the sixth to final stations. Note that, FIGS. 5A and 5B are cross-sectional views of the portion 10*a* of the hat-shaped steel 1, but the other portions 10*b*, 11, 12*a*, and 12*b* are also bent in stages to the hat shape at the 10 stages of the roll units 20*a* to 20*k*. Therefore, the material (intermediate) which is roll formed at the ninth station becomes a shape close to the final product and is finally shaped by the 10th finishing roll.

Figure 6:
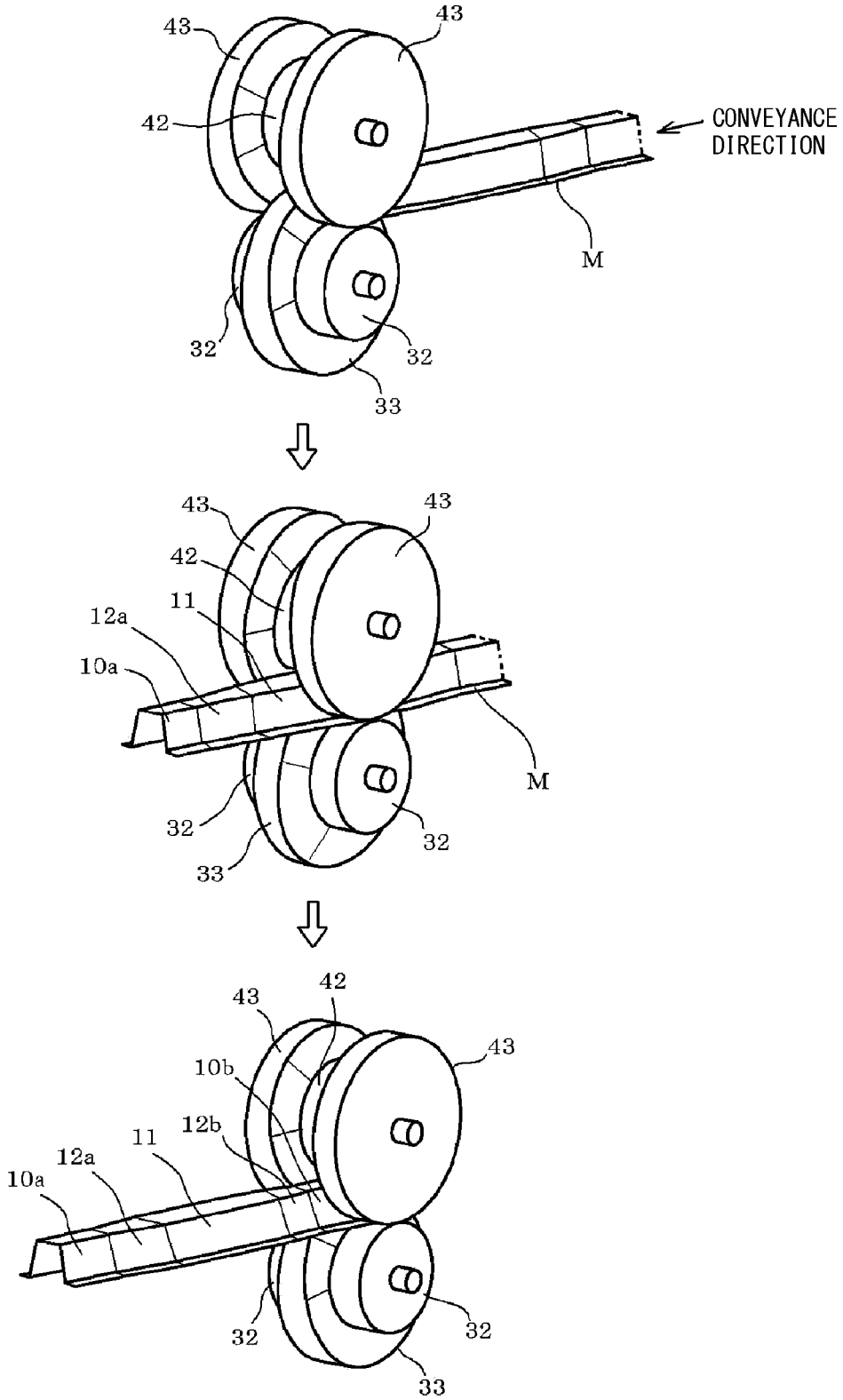
FIG. 6 is a schematic perspective view for explaining the action in one roll unit.

The state where the finishing rolls perform the final forming operation is shown in FIG. 6. In the sheet or strip M (intermediate) which is conveyed from upstream, the width L1 portion 10*a* is formed by the back half part from the start point to the regions 33*a* and 43*a* of the first top and bottom rolls, then the gradually increasing width portion 12*a* is formed by the regions 33*c* and 43*c* and, furthermore, the width L2 portion 11 is formed by the regions 33*b* and 43*b*. Next, the gradually decreasing width portion 12*b* is formed by the regions 33*d* and 43*d* and finally the width L1 portion 10*b* is formed by the front half part from the start point of the regions 33*a* and 43*a*. At this time, the back half part of the regions 33*a* and 43*a* forms the width L1 portion 10*a* of the next product.

Figure 7A:
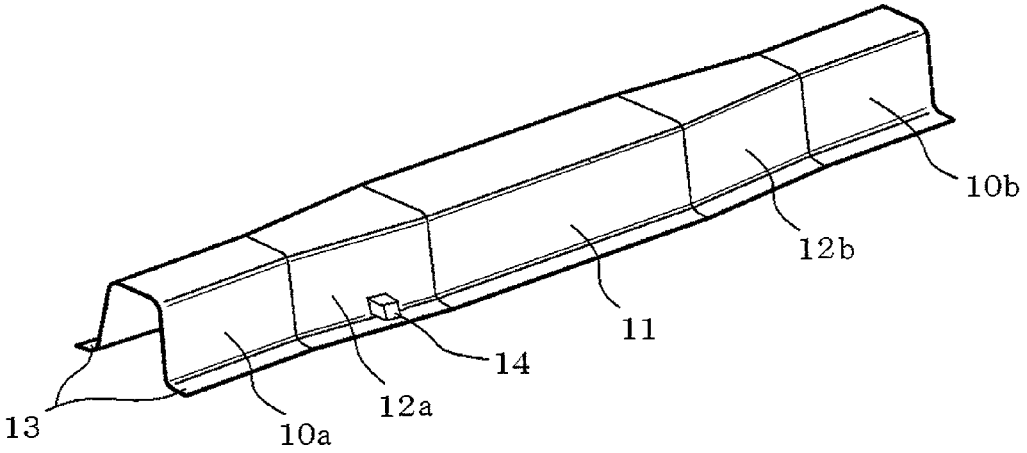
FIG. 7A is a perspective view of a hat-shaped steel which has a bead.
Figure 7B:
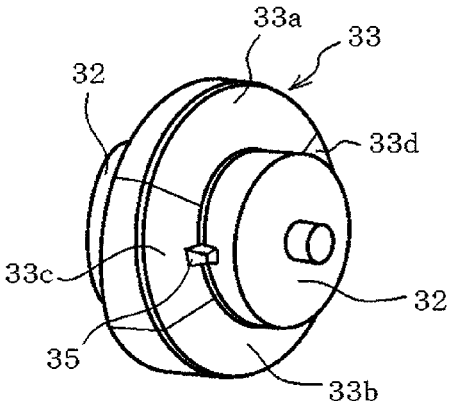
FIG. 7B is a perspective view of rolling dies which form the hat-shaped steel of FIG. 7A.

The finished product which is fed out from the finishing roll after final shaping is completed is cut at the position forming the terminating end (that is, the end part of the portion 10*b*) and, is conveyed to other next step, for example, to the product inspection step. The cutting position can be automatically discerned by for example detecting a mark (for example, small hole, projection, etc.) which is formed at intervals in the length direction of the sheet or strip M, by a sensor. The mark may be provided at intervals corresponding to the lengths of the finished products at the sheet or strip M in advance or may be provided during roll forming. As the method of providing a mark during roll forming, using top and bottom rolls 4 and 3 which are formed with projections forming the mark at a position corresponding to the starting point of the rolls so as to transfer a mark along with bending to the hat shape may be mentioned as one example. In addition to a mark, a predetermined relief shape may be formed on the surface of the roll barrel part so as to form a bead, embossing, or other shape. FIGS. 7A and 7B show an example of a bead 14 and a projecting part 35 which is formed at a roll barrel part for forming the bead 14. While not illustrated, the top roll 4 is formed with a recessed part which corresponds to the projecting part 35 though a gap of the amount of thickness of the material. The shapes, positions, and numbers of the beads and embossing can be suitably changed.

According to the present embodiment, when using a bottom roll 3 which has an annular ridge part 33 and a top roll 4 which has an annular groove part which faces the annular ridge part 33 to produce a hat-shaped steel 1, by the shapes of the annular ridge part 33 and the annular groove part 42 being made shapes which vary in cross-sectional shape in the circumferential direction, a hat-shaped steel 1 which varies in cross-sectional shape (that is, the hat shape) in the longitudinal direction can be produced by simple control for making the top and bottom rolls 4 and 3 rotate synchronized.

In this way, the roll forming according to the present embodiment does not require the complicated control method for changing the roll widths of split rolls like in the past, and therefore does not require the introduction of new control modules for this purpose. Accordingly, for example, it is possible to realize the roll forming apparatus of the present embodiment by changing the rolls of an existing roll forming apparatus to the top and bottom rolls 4 and 3 of the present embodiment.

Note that, in the multistage roll forming apparatus 2 of FIG. 2, the roll units 20*a* to 20*k* are arranged on a line, but if arranging the roll units 20*a* to 20*k* in tandem curved in the up-down direction, it becomes possible to produce a hat-shaped steel which is curved in the longitudinal direction.

Furthermore, according to the present embodiment, by the roll barrel part which varies in cross-sectional shape in the circumferential direction, the roll barrel part and material can sufficiently contact each other in the forming operation, and therefore for example even if the material is high tensile steel, insufficient mill rigidity can be suppressed. Accordingly, the roll forming method and apparatus of the present embodiment can also be applied to tensile strength 980 MPa or more ultra high tensile steel.

Second Embodiment

Figure 8:
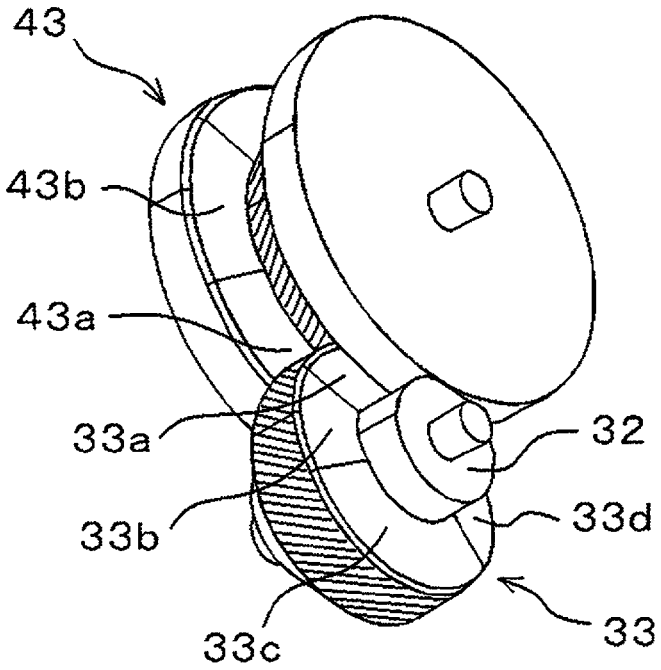
FIG. 8 shows rolling dies according to a second embodiment.

Next, a modification of the rolling dies which are shown in the above-mentioned first embodiment will be explained. In the rolling dies of the present embodiment, as shown in FIG. 8, the outside diameter of the annular ridge part 33 of the bottom roll 3 (hatched part) and the outside diameter of the bottom surface of the flank part 43 of the top roll 4 (hatched part) are the same, and the side walls of the annular ridge part 33 of the bottom roll 3 are provided with the later explained relief. Leaving aside this feature, the top and bottom rolls 4 and 3 of the present embodiment are substantially the same as the top and bottom rolls 4 and 3 of the first embodiment. Similar component elements are assigned the same reference notations, and detailed explanations are omitted.

Figure 9:
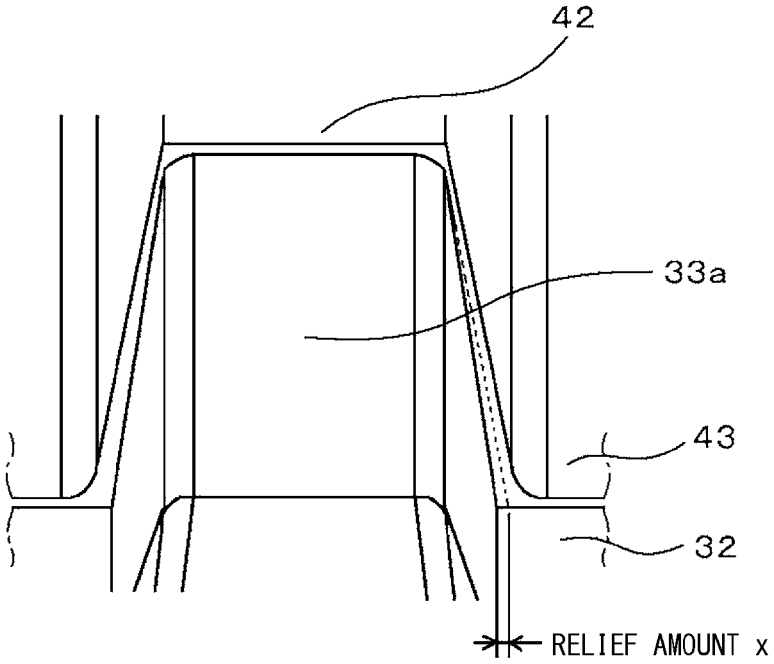
FIG. 9 is a partial cross-sectional view of the rolling dies of FIG. 8.

The relief which is provided at the side surfaces of the ridge part 33 of the bottom roll 3 will be explained in detail. FIG. 9 is a partial vertical cross-sectional view which is cut along the plane which includes the center axes of the top and bottom rolls 4 and 3. In the first embodiment, the gap between the facing bottom surfaces and side surfaces of the top and bottom rolls 4 and 3 was constant over the entire circumference in the circumferential direction, but in the present embodiment, the side surfaces of the annular ridge part 33 of the bottom roll 3 are offset by the relief amount x to the inside of the axial direction of the roll from the inside surface of the designed hat-shaped steel 1. By providing relief to the side surfaces of the annular ridge part 33 in this way, the gap between the side surfaces of the annular ridge part 33 and the side surfaces of the annular groove part 42 becomes wider the further toward the base of the annular ridge part 33, that is, the inside in the radial direction. In the figure, the broken line shows a side surface when not providing the relief. In the case of the bottom roll 3 of the final station, when working as one example a material of a sheet thickness of 1.0 mm, the relief amount x is preferably 1.4 mm or more. The method of determination of the relief amount will be explained later.

Figure 10:
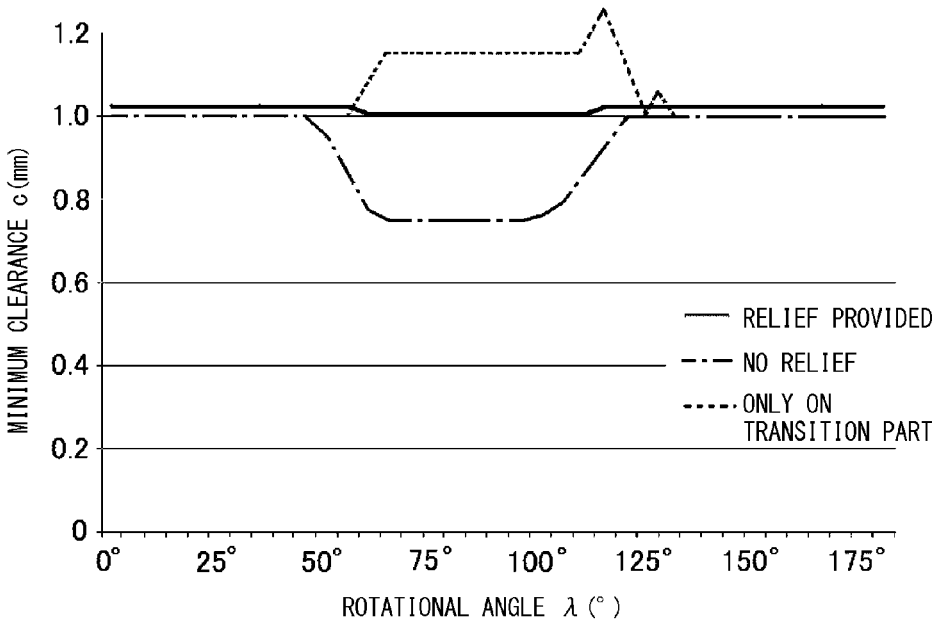
FIG. 10 is a chart which shows a minimum gap when providing relief at the rolling dies.

FIG. 10 shows the result of comparison of the gaps between the top and bottom rolls 4 and 3 in the case of relief and no relief. More specifically, FIG. 10 shows the minimum distance (minimum gap) between the side surfaces at the different phases when designating the start points of the top and bottom rolls 4 and 3 (see FIG. 4) as 0° and making the top and bottom rolls 4 and 3 rotate in 50 increments. As will be clear from FIG. 10, it is learned that when not providing relief, the gap greatly varies (decreases and increases) at the about 45° to 65° region and the 100° to 120° region. FIGS. 11A and 11B show results of numerical analysis which show the interference between rolls when not providing relief. The parts which are shown by hatching show the interference regions. The regions in which the gap varies correspond to the transition parts 33*c*, 33*d*, 43*c* and 43*d* of the top and bottom rolls 4 and 3.

On the other hand, it is learned that when providing relief, the gap is varied in the transition parts 33*c*, 33*d*, 43*c* and 43*d*, but the amount of variation thereof is extremely small and the gap is maintained substantially constant over 0° to 180° as a whole. While depending on the thickness or shape of the shaped steel, the preferable minimum gap when considering the product specifications etc. becomes the thickness of the sheet or more. According to the present embodiment, by providing relief at the side surfaces of the annular ridge part 33 of the bottom roll 3, it becomes possible to secure a minimum gap of the sheet thickness or more. Further, in order to compare, FIG. 10 shows the gap in the case where relief is provided only on the transition parts 33*c* and 33*d* and is not provided on the other regions. As will be understood from FIG. 10, the gap cannot be maintained constant by merely providing the relief only on the transition parts 33*c* and 33*d*. In addition, providing the relief only on the transition parts 33*c* and 33*d* has a disadvantage in that it is more difficult than providing the relief on all of the side surfaces.

The variation in the gap between the top and bottom rolls 4 and 3 in the circumferential direction may result in a variation in thickness of products. Therefore, it is significantly advantageous that the gap between the top and bottom rolls 4 and 3 in the circumferential direction can be substantially constant by providing a relief on the side surfaces of the annular ridge part 33 of the bottom roll 3 so as to offset in the axial inner direction of the roll. In addition, in the case where the relief if provided on the annular ridge part 33, in addition to enabling the gap to be maintained substantially constant, the effect that a generation of slip of the sheet on the side surface of the bottom roll 3 is suppressed to prevent generation of wrinkling, can be obtained, and it is possible to prevent a reduction in sheet thickness at the base region of the annular ridge part 33, which prevents the sheet thickness from falling below a fracture criteria. From the above, in the second embodiment as well, it is possible to obtain effects similar to the first embodiment and, furthermore, it is possible to form a shaped steel which is kept down in variation in sheet thickness.

Note that, it is preferable to provide relief at the side surfaces of the annular ridge part 33 of the bottom roll 3 not only at the roll unit 20*a* of the final station, but also part or all of the other roll units 20*b* to 20*k* which are arranged upstream of it. The multistage roll forming apparatus 2 which is shown in FIG. 2 bends the top wall of the hat-shaped steel 1 in five steps from the sixth station to the final station (10th station), and therefore it is preferable to provide relief at the bottom rolls 3 of these stations.

Figure 11:
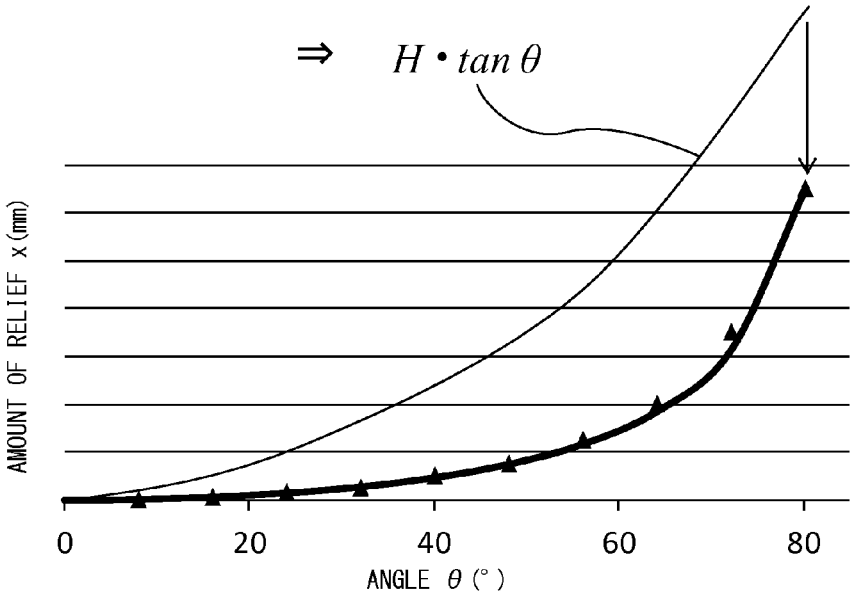
FIG. 11 is a chart explaining a relationship between a relief amount x and a side wall angle θ of a shaped steel and a height H of an annular ridge part of a bottom roll.
Figure 12A:
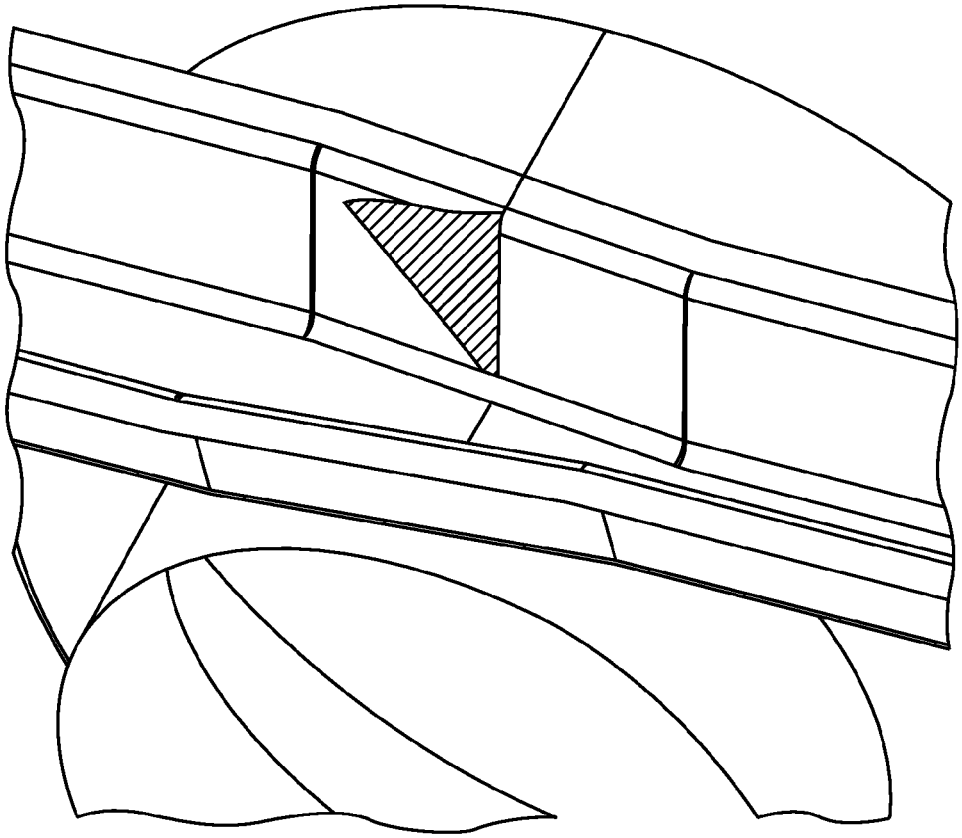
FIG. 12A is a perspective view which shows interference between a top roll and a bottom roll when not providing relief and shows together a hat-shaped steel.
Figure 12B:
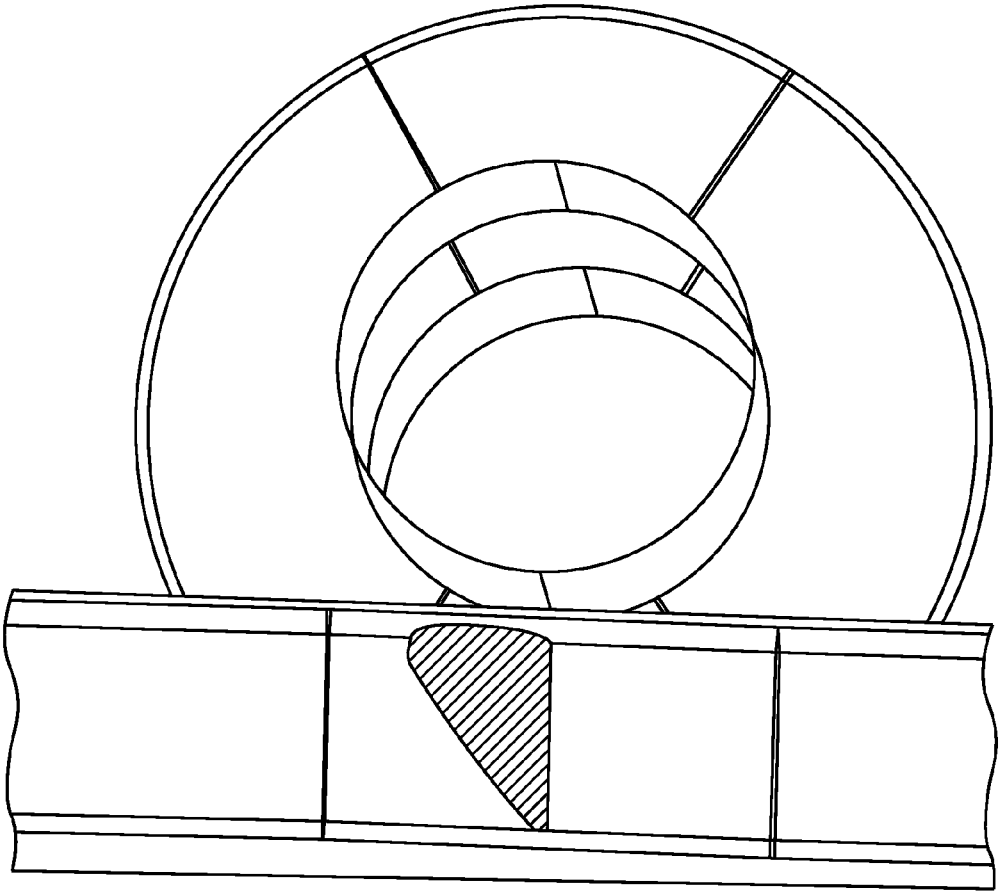
FIG. 12B is a perspective view which shows interference between a top roll and a bottom roll when not providing relief and shows together a hat-shaped steel.
Figure 13A:
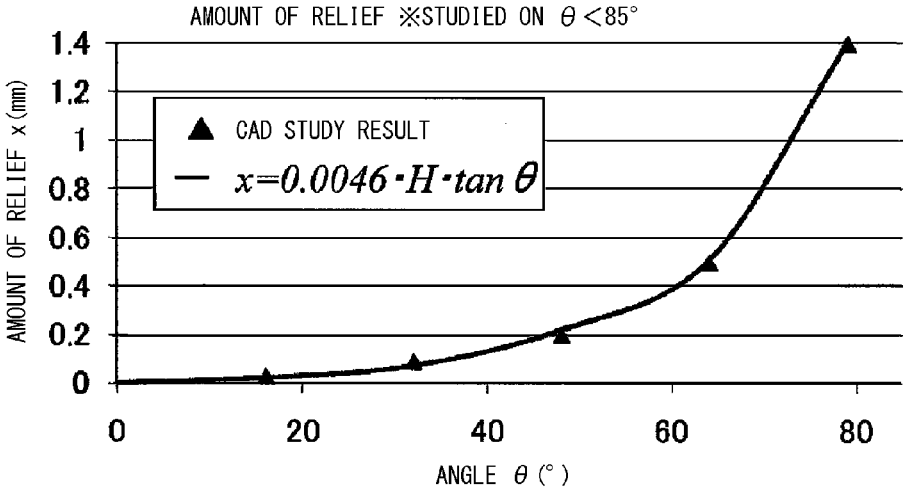
FIG. 13A is a chart explaining a relationship between a relief amount x, and a side wall angle θ of a shaped steel and a height H of an annular ridge part of a bottom roll.
Figure 13B:
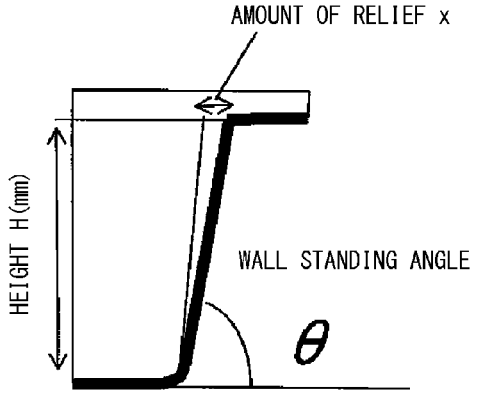
FIG. 13B is a partially enlarged view of a bottom roll which shows a relief amount x, a side wall angle θ of a shaped steel, and a height H of an annular ridge part.

However, the top and bottom rolls 4 and 3 of the stations differ in roll shape (in particular, the inclination of the annular ridge part 33), and therefore each of them has a preferable relief amount. Therefore, the inventors etc. engaged in actual designs and conducted intensive studies and as a result discovered that the preferable relief amount x has a relationship $x=\alpha\times H\times\tan\theta$ with respect to the angle θ of the side walls of the shaped steel and the height H of annular ridge part 33. In this regard, the relief amount x, the side wall angle θ of the shaped steel, and the height H of the annular ridge part 33 are as shown in FIG. 13B. Referring to FIG. 11, it will be understood that the actual relief amount x is a value of $H\times\tan\theta$ multiplied by the constant α ($\alpha<1$).

FIG. 13C shows the minimum gap between the top and bottom rolls 4 and 3 when several relief amounts (intervals of 0.1 mm) are set with respect to the angle θ of the side walls of the shaped steel which is bent in different stations. Further, based on the result shown in FIG. 13C, it was judged to be impossible to perform forming in the case of the relief amount in which the minimum gap is lower than the sheet thickness, and the minimum value of the relief amount x in which the minimum gap is not less than the sheet thickness was confirmed.

Further, as a result of studying the relationship among the relief amount x, the side wall angle θ and the height H of the annular ridge part 33, it is confirmed that the minimum gap of 1 mm is secured by providing a relief of not less than an amount calculated by the correlation equation: $x=0.0046\times H\times\tan\theta$ (note that $\theta<85°$) shown in FIG. 13A. Note that, 0.0046 in the equation is determined depending on the roll shape. That is, by providing a relief amount x corresponding to $x=0.0046\times H\times\tan\theta$ (note that $\theta<85°$) with respect to the bottom roll 3 of each station performing the bent of the top wall, the variation in sheet thickness of the shaped steel which is bent in each station can be suppressed. Moreover, the preferable relief amount x can be calculated from the above equation, and therefore for example even if changing the shapes of the rolls, the preferable relief amount x can be easily derived. Below, one example of this will be explained.

The multistage roll forming apparatus 2 of FIG. 2 forms the flanges in the first half process and bends the top wall in the second half process (see FIG. 5). In this case, for example, when changing the target shape of the shaped steel, there is the advantage that it is only necessary to change part of the rolls. On the other hand, since the top wall is bent in the latter five steps, the amount of bending per step is large and in some cases the material is liable to fracture etc.

Figure 14:
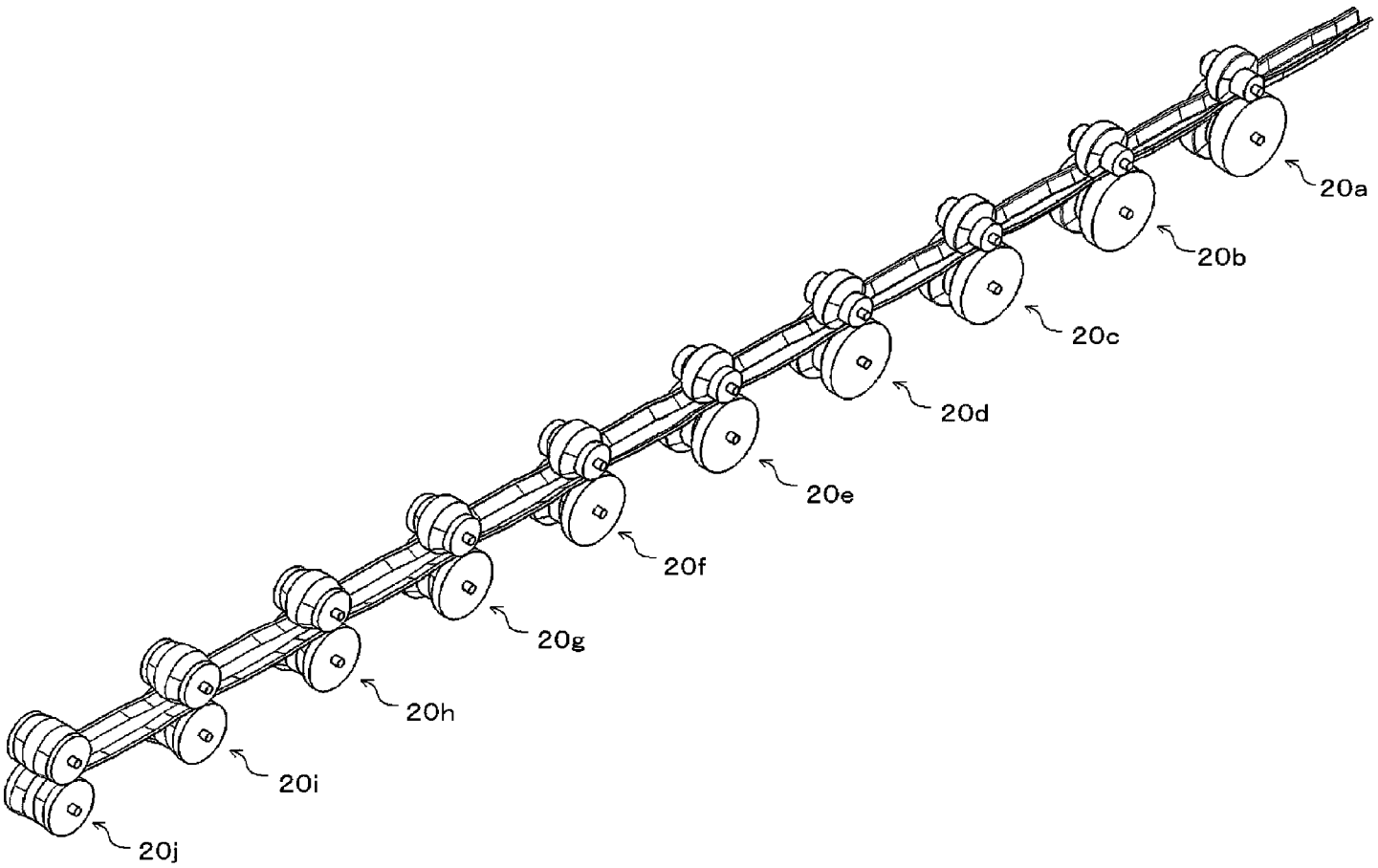
FIG. 14 is a perspective view which shows another example of a multistage roll forming apparatus.
Figure 15:
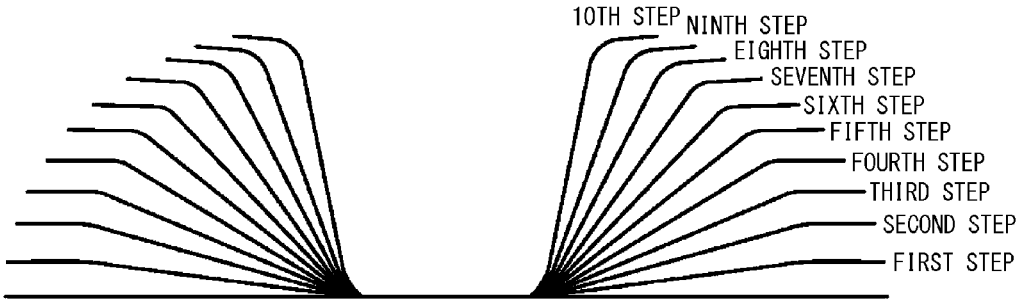
FIG. 15 is a view which shows a bending process at different stages of the multistage roll forming apparatus of FIG. 18.

Therefore, as another example, the multistage roll forming apparatus 2 which is shown in FIGS. 14 and 15 is configured to bend the top wall in stages at all of the stations from the first station to the 10th station (final station). In this case, for example, there is the shortcoming that when changing the target shape of the shaped steel, all of the rolls have to be changed, but on the other hand the amount of bending per step can be smaller, and therefore there is the advantage that fracture of the material can be prevented.

Figure 16A:
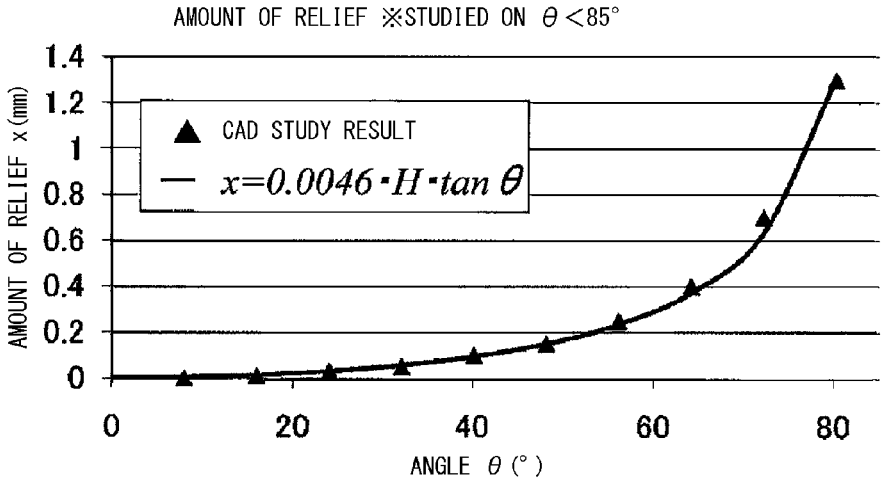
FIG. 16A is a chart explaining a relationship between a relief amount x, and a side wall angle θ of a shaped steel and a height H of an annular ridge part of a bottom roll.
Figure 16B:
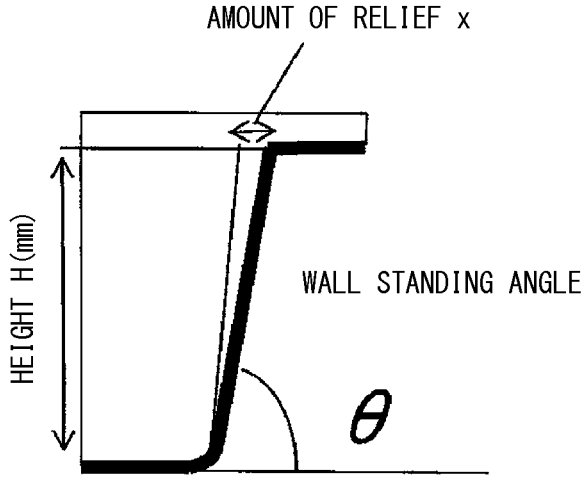
FIG. 16B is a partially enlarged view of a bottom roll which shows a relief amount x, a side wall angle θ of a shaped steel, and a height H of an annular ridge part.

In this way, even when the roll shape varies at each station, by setting a relief amount x according to the above equation: $x=0.0046\times H\times\tan\theta$ (note that $\theta<85°$) as shown in FIGS. 16A-16C, it was confirmed that a 1 mm or more minimum gap can be secured.

Note that the constant α in the above equation can be determined by obtaining several kinds of data shown in FIGS. 13A-13C and FIGS. 16A-16C, and deriving a correlation equation. Further, the constant α can be calculated based on $\alpha\ (\text{constant})=x/(H\times\tan\theta)$, for example, by simultaneously rotating the top and bottom rolls 4 and 3 of the final station and studying the minimum gap between the top and bottom rolls 4 and 3, and by determining the appropriate relief amount x of the top and bottom rolls 4 and 3 of the final station so that the minimum gap is the thickness of the sheet (for example, 1 mm) running therebetween. These series of operations can be performed by for example using a designing CAD.

Further, if the constant α is determined according to the roll shapes of the final station, the equation: $x=\alpha\times H\times\tan\theta$ is used to calculate the optimum relief amount of the rolls of the step before the final station. In the example of FIG. 2, the rolls of the sixth station to ninth station are covered, while in FIG. 17C, the rolls of the first station to ninth station are covered. That is, the constant α which is determined using the top and bottom rolls 4 and 3 of the final station is used for finding the optimum relief amount x of the top and bottom rolls of the other stations. Due to this, the minimum gap can be secured even at the other stations. Further, it becomes possible to efficiently design a series of a plurality of multistage rolls. This method of design of rolls can be applied to various shapes of rolls. Of course, it may also be applied to the shapes of the rolls which are shown in the later explained third to ninth embodiments.

Figure 17:
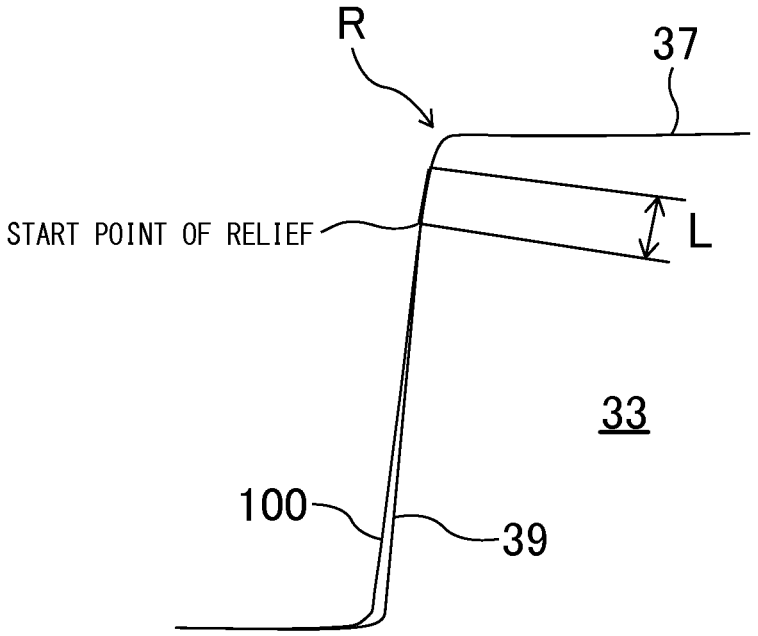
FIG. 17 is a view which shows a start point of relief provided at an annular ridge part of a bottom roll.

Furthermore, preferably, as shown in FIG. 17, the corner parts between the outer circumferential surface 37 of the annular ridge part 33 of the bottom roll 3 and the side surfaces 39 are made to curve in an arc shape by giving them roundness, and the start points of relief are arranged at positions where straight parts 33*s* of lengths L are provided from the corner parts along the side surfaces 39. Note that, in FIG. 17, the straight line 100 shows the inner surface of the designed hat-shaped steel 1. By providing straight parts, which are not provided with relief, along the inner surfaces of the designed hat-shaped steel 1 at the side surfaces 39 of the annular ridge part 33 in this way, the workpiece is bent in a state firmly clamped between the outer circumferential surface 37 of the annular ridge part 33 of the bottom roll 3 and the bottom surface of the annular groove part 42 of the top roll 4, between the rounded corner parts of the annular ridge part 33 of the bottom roll 3 and the rounded corner parts of the inside surface of the annular groove part 42 of the top roll 4 which correspond to the corner parts of the annular ridge part 33, and between the straight parts which adjoin the rounded corner parts at the side surfaces of the annular ridge part 33 and the straight parts which correspond to those straight parts at the inside surface of the annular groove part 42 of the top roll 4. As a result, wrinkling which may be generated on the top wall of hat-shaped steel 1 can be prevented.

Note that, the shapes of the top and bottom rolls 4 and 3 according to the above-mentioned embodiments are examples for producing the hat-shaped steel 1 which is shown in FIG. 1. The target shape of the finished product is of course not limited to the hat-shaped steel 1 which is shown in FIG. 1. For example, the portions 10*a* to 12*b* may be different in gradient angles of the side walls and may be further provided with portions of different widths from L1 and L2. Further, the hat-shaped steel 1 of FIG. 1 forms a symmetric shape in the left-right direction and front-back direction, but may also form an asymmetric shape in the left-right direction and front-back direction.

Furthermore, the shaped steel which is produced is also not limited to a hat-shaped steel. For example, it is possible to make the cross-sectional shape of the annular ridge part 33 a square shape and produce a shaped steel with a cross-sectional shape of a staple shape or to make the top part of the annular ridge part 33 curved to make the cross-sectional shape a U-shape. Further, it is possible to make the cross-sectional shape of the annular ridge part 33 a triangular shape and produce a shaped steel with a cross-sectional shape of a V-shape. In each case, by using a roll with a cross-sectional shape of the annular ridge part 33 which is varied in the circumferential direction, a staple shaped steel, U-shaped steel, or V-shaped steel which varies in cross-sectional shape in the longitudinal direction is formed. Furthermore, it is possible to vary to a different shape, for example, from a hat-shape to a U-shape, in the longitudinal direction. The invention is not limited to these, but modifications of the shaped steels which are produced and examples of the finishing rolls for forming the shaped steels will be explained while referring to FIG. 18A to FIG. 26B.

Third Embodiment

Figure 18A:
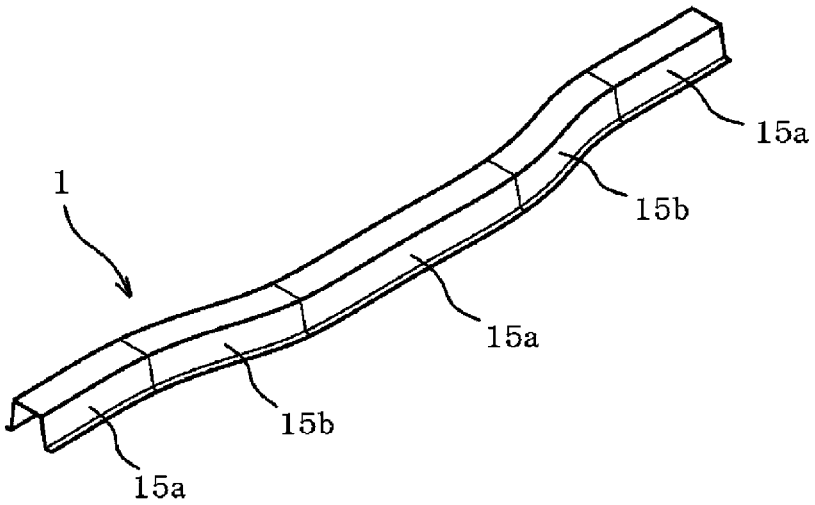
FIG. 18A is a perspective view of a shaped steel according to a third embodiment.
Figure 18B:
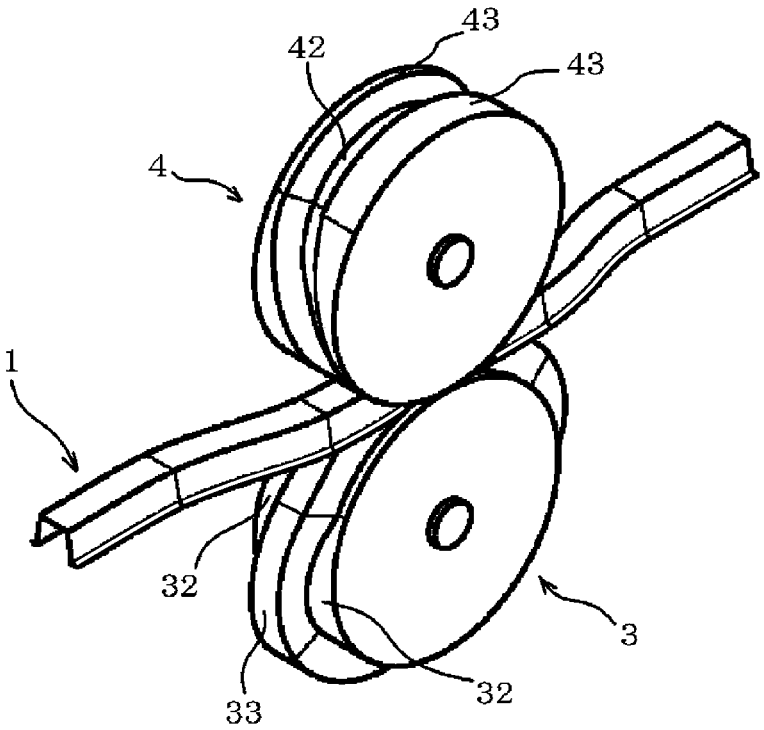
FIG. 18B is a perspective view of rolling dies according to a third embodiment which is shown together with the shaped steel of FIG. 18A.

FIG. 18A shows a hat-shaped steel 1 with a constant width and height but with a cross-section which moves in the lateral direction, while FIG. 18B shows the top and bottom rolls 4 and 3 which form the hat-shaped steel 1 of FIG. 18A by the final forming operation. That is, in the above first embodiment, a hat-shaped steel with a straight stock axis was produced, but in the present embodiment, a hat-shaped steel 1 with a stock axis which is curved in the width direction is produced. This hat-shaped steel 1 has portions 15*a* of a straight stock axis and portions 15*b* of a curved stock axis. As the rolls for this, as shown by the example in FIG. 18B, top and bottom rolls 4 and 3 which have an annular ridge part and annular groove part offset in the rotational axial direction are used. The overall configuration of the roll unit which drives rotation of the top and bottom rolls 4 and 3 can be configured in the same way as in the first embodiment.

According to the present embodiment, by simple control for making the top and bottom rolls rotate synchronized, a hat-shaped steel with a cross-sectional shape in the longitudinal direction which curves in the width direction can be produced. Furthermore, if arranging the roll units 20*a* to 20*k* in tandem curved in the up-down direction, a hat-shaped steel which is curved in the longitudinal direction can also be produced.

Fourth Embodiment

Figure 19A:
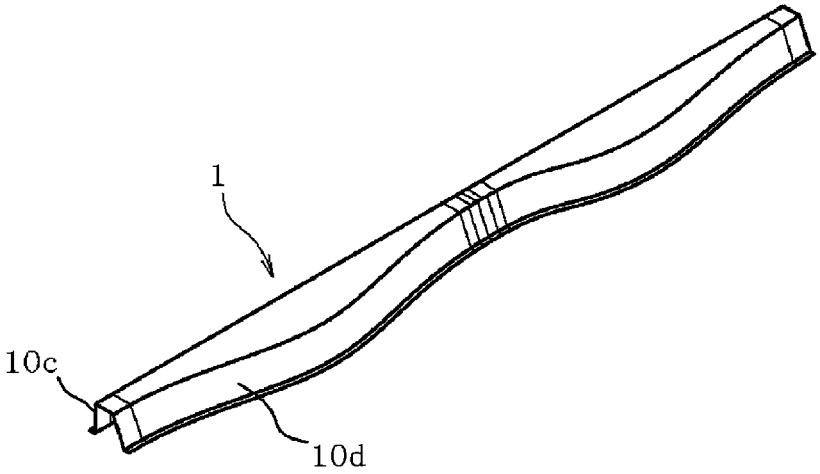
FIG. 19A is a perspective view of a shaped steel according to a fourth embodiment.
Figure 19B:
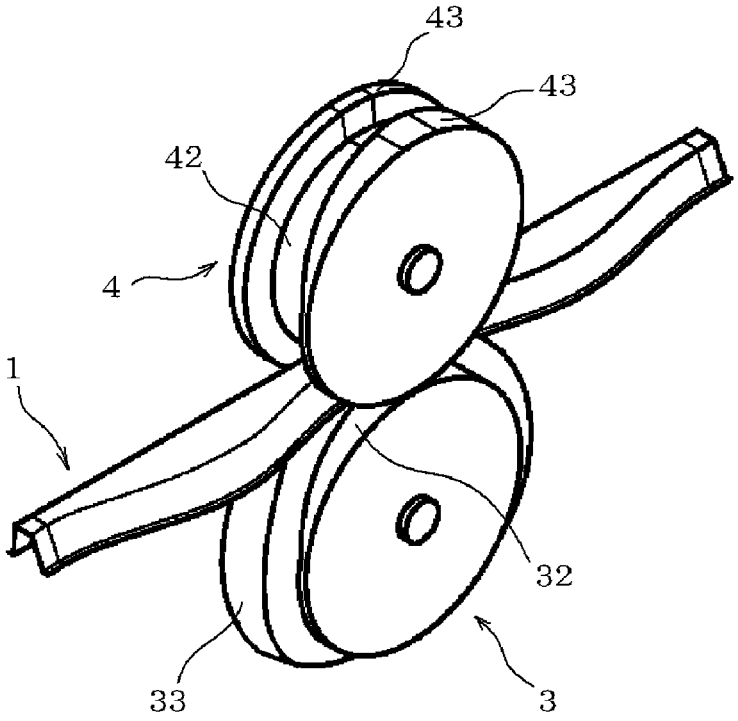
FIG. 19B is a perspective view of rolling dies according to a fourth embodiment which is shown together with the shaped steel of FIG. 19A.

FIG. 19A shows a hat-shaped steel 1 with a constant height and a width in cross-sectional shape which varies asymmetrically to the left and right, while FIG. 19B shows the top and bottom rolls 4 and 3 which form the final shape of the left-right asymmetric hat-shaped steel 1 which is shown in FIG. 19A. That is, in the present embodiment, the top and bottom rolls 4 and 3 which are shown in FIG. 18B are used to produce a hat-shaped steel 1 which has one side wall 10*c* of the hat shape which is constant and has only the other side wall 10*d* changing in the width direction. The overall structure of the roll unit which drives rotation of the top and bottom rolls 4 and 3 can be configured in the same way as in the first embodiment. In this case as well, by simple control for making the top and bottom rolls 4 and 3 rotate synchronized, a hat-shaped steel which varies asymmetrically left and right in cross-sectional shape width in the longitudinal direction can be produced.

Fifth Embodiment

Figure 20A:
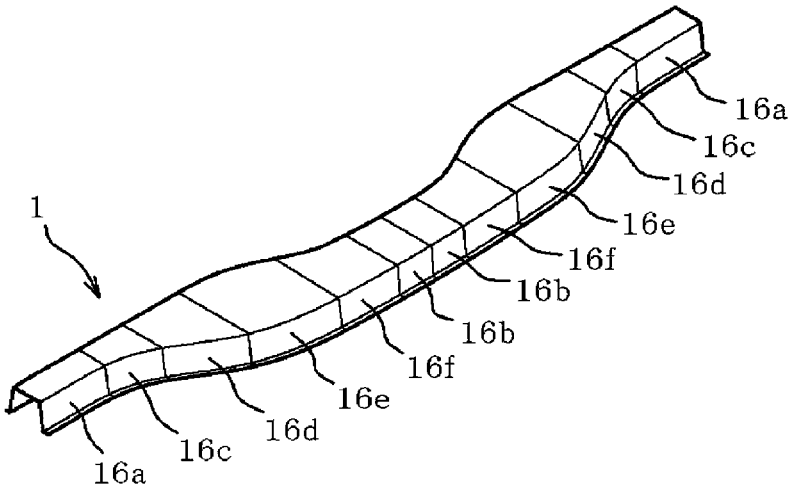
FIG. 20A is a perspective view of a shaped steel according to a fifth embodiment.
Figure 20B:
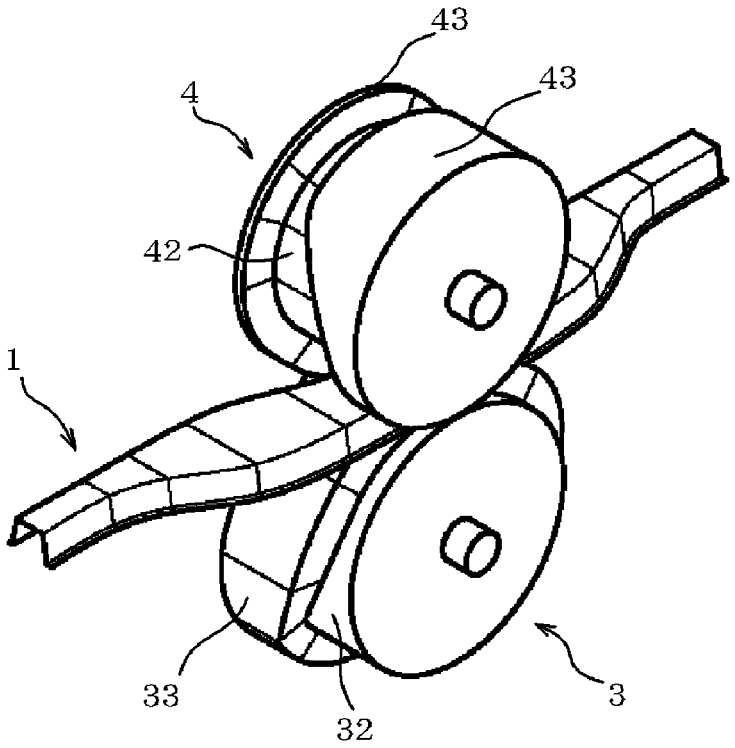
FIG. 20B is a perspective view of rolling dies according to a fifth embodiment which is shown together with the shaped steel of FIG. 20A.

FIG. 20A shows a hat-shaped steel 1 with a constant height and a complicated changing width in cross-sectional shape, while FIG. 20B shows the top and bottom rolls of the final station for the hat-shaped steel 1 which is shown in FIG. 20A. That is, in the present embodiment, the top and bottom rolls 4 and 3 which are shown in FIG. 20B are used to produce the hat-shaped steel 1 which is further provided with portions of widths different from L1 and L2. More specifically, the hat-shaped steel 1 of the present embodiment has straight portions 16*a* and 16*b* and portions 16*c* to 16*f* which have different widths. The overall structure of the roll unit which drives rotation of the top and bottom rolls 4 and 3 can be configured in the same way as in the first embodiment. In this case as well, by simple control for making the top and bottom rolls 4 and 3 rotate synchronized, a hat-shaped steel which varies complicatedly in width of cross-sectional shape in the longitudinal direction can be produced.

Sixth Embodiment

Figure 21A:
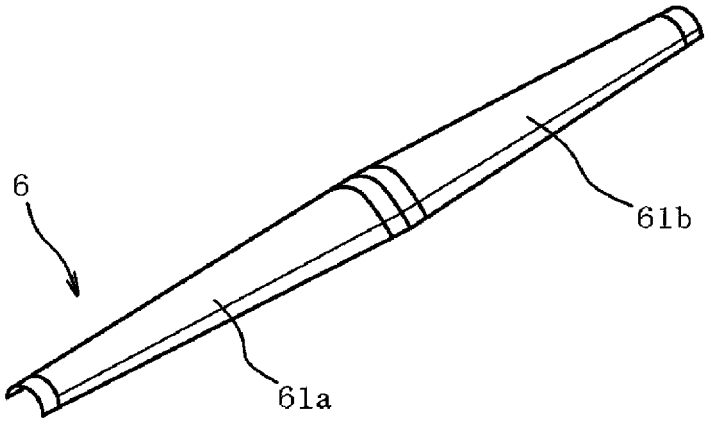
FIG. 21A is a perspective view of a shaped steel according to a sixth embodiment.
Figure 21B:
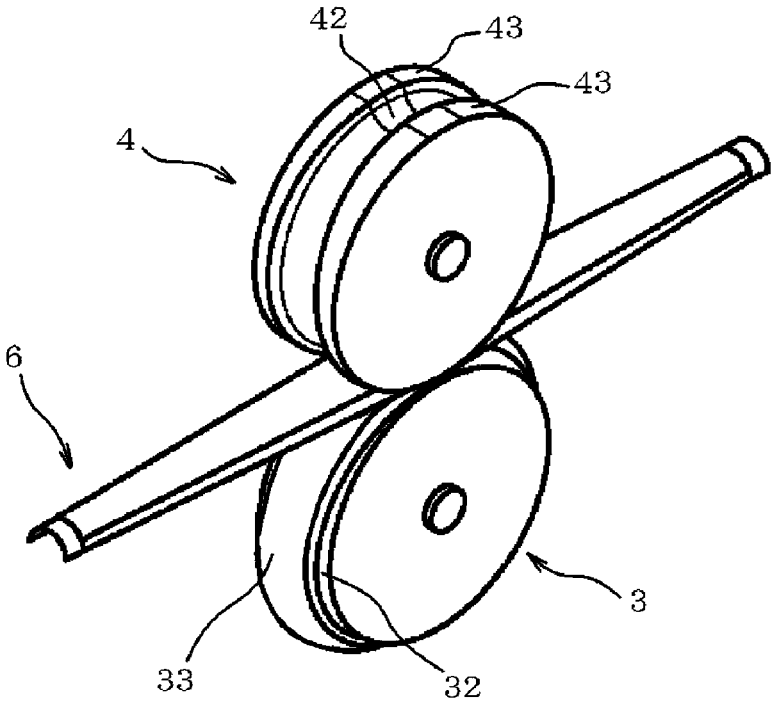
FIG. 21B is a perspective view of rolling dies according to a sixth embodiment which is shown together with the shaped steel of FIG. 21A.

In the present embodiment, a steel shape which forms a cross-sectional U-shape is produced. FIG. 21A shows a U-shaped steel 6 with a constant height and a changing width in cross-sectional shape, while FIG. 21B shows the top and bottom rolls 4 and 3 of the final station for the U-shaped steel 1 which is shown in FIG. 21A. The U-shaped steel 6 of the present embodiment has a constant height and expanded width portion 61*a* and a constant height and contracted width portion 61*b*. The rolling dies for this include an annular ridge part of the bottom roll 3 with a cross-sectional inverted U-shape which expands in width in the circumferential direction in the range of 0° to 180° and contracts in width in the range of 180° to 360°. The annular groove part of the top roll 4 which faces the bottom roll 3 also forms a U-shape which expands and contracts in width in the circumferential direction. The overall structure of the roll unit which drives rotation of the top and bottom rolls 4 and 3 can be configured in the same way as in the first embodiment. In this case as well, by simple control for making the top and bottom rolls 4 and 3 rotate synchronized, a U-shaped steel 6 which varies in cross-sectional shape width in the longitudinal direction can be produced.

Seventh Embodiment

Figure 22A:
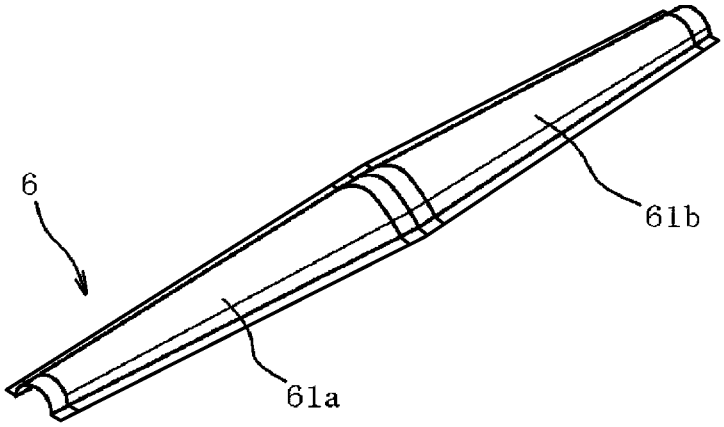
FIG. 22A is a perspective view of a shaped steel according to a seventh embodiment.
Figure 22B:
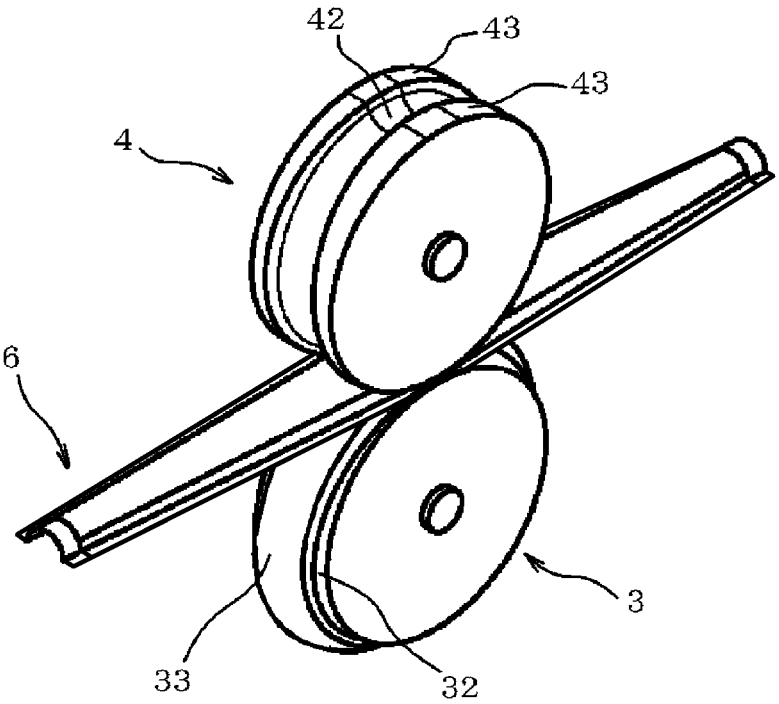
FIG. 22B is a perspective view of rolling dies according to a seventh embodiment which is shown together with the shaped steel of FIG. 22A.

The U-shaped steel 6 of FIGS. 22A and 22B is substantially the same as the U-shaped steel 6 of FIGS. 21A and 21B, except for being provided with the flanges 63. In this case as well, by simple control for making the top and bottom rolls 4 and 3 rotate synchronized, a U-shaped steel 6 which varies in cross-sectional shape width in the longitudinal direction can be produced.

Eighth Embodiment

Figure 23A:
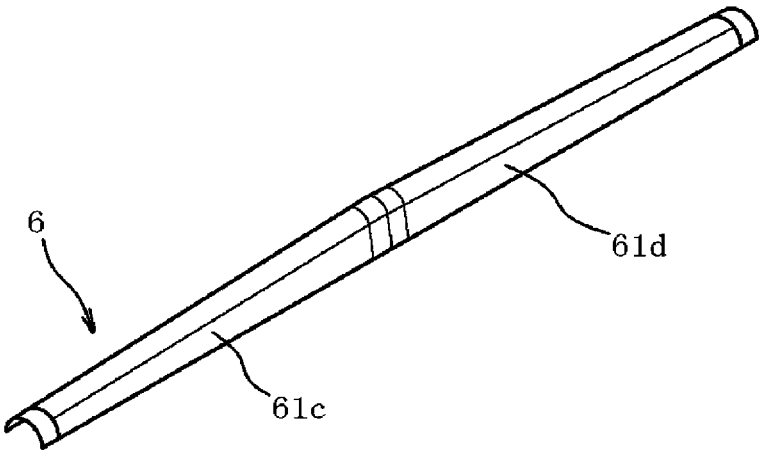
FIG. 23A is a perspective view of a shaped steel according to an eighth embodiment.
Figure 23B:
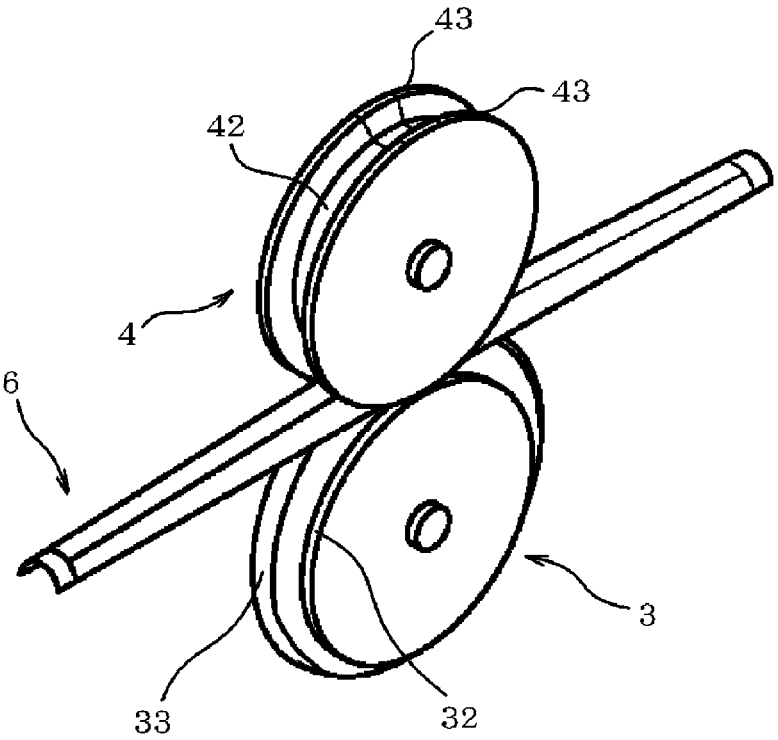
FIG. 23B is a perspective view of rolling dies according to an eighth embodiment which is shown together with the shaped steel of FIG. 23A.

The present embodiment also produces shaped steel having a U-shape cross-section. However, while the above-mentioned fifth embodiment has a constant height, in the present embodiment, as shown in FIG. 23A, a U-shaped steel 6 with a constant width and a changing height is produced. More specifically, the U-shaped steel 6 of the present embodiment has a heightening portion 61*c* with a constant width and a lowering portion 61*d* with a constant width. FIG. 23B shows the top and bottom rolls 4 and 3 of the final station for the U-shaped steel 6 which is shown in FIG. 23A. The annular ridge part of the bottom roll 3 has a cross-sectional outer shape of an inverted U-shape, expands in outside diameter in the circumferential direction in the range of 0° to 180°, and contracts in outside diameter in the range of 180° to 360°. The recessed part of the top roll 4 which faces the bottom roll 3 also has a U-shape which varies in height in the circumferential direction. The overall structure of the roll unit which drives rotation of the top and bottom rolls 4 and 3 can be configured in the same way as in the first embodiment. In this case as well, by simple control for making the top and bottom rolls 4 and 3 rotate synchronized, a U-shaped steel 6 which varies in cross-sectional shape height in the longitudinal direction can be produced.

Ninth Embodiment

Figure 24A:
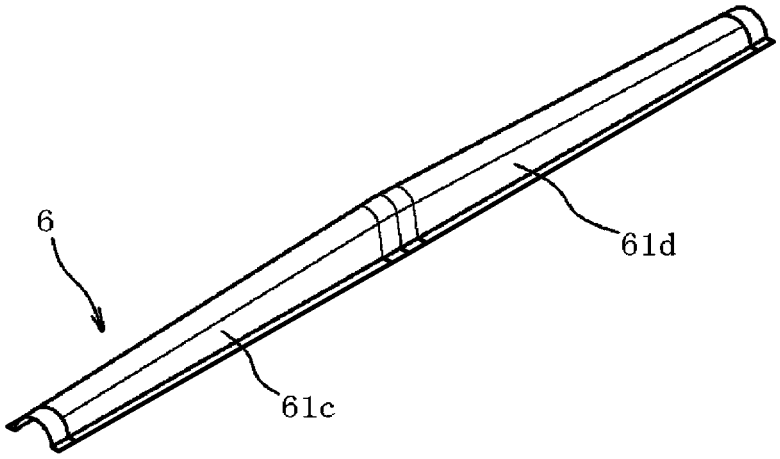
FIG. 24A is a perspective view of a shaped steel according to a ninth embodiment.
Figure 24B:
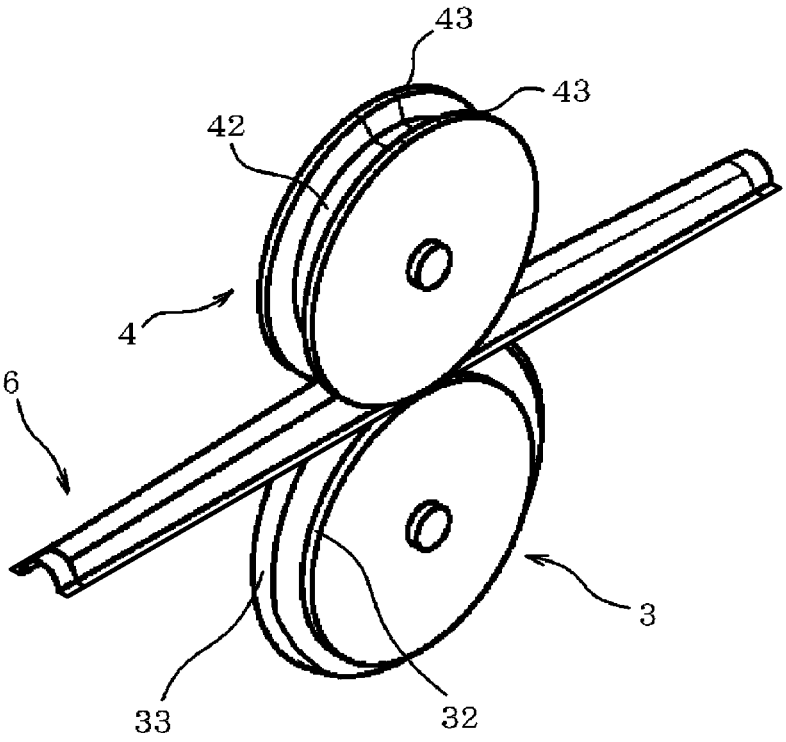
FIG. 24B is a perspective view of rolling dies according to a ninth embodiment which is shown together with the shaped steel of FIG. 24A.

Except for the point of the U-shaped steel 6 of FIGS. 24A and 24B being provided with the flanges 63, this is substantially the same as the U-shaped steel 6 of FIGS. 22A and 22B. In this case as well, by simple control for making the top and bottom rolls 4 and 3 rotate synchronized, a U-shaped steel 6 which varies in cross-sectional shape width in the longitudinal direction can be produced.

10th Embodiment

Figure 25A:
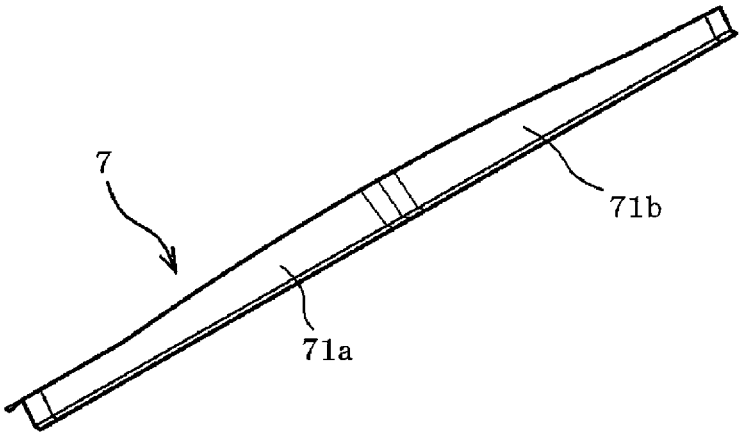
FIG. 25A is a perspective view of a shaped steel according to a 10th embodiment.
Figure 25B:
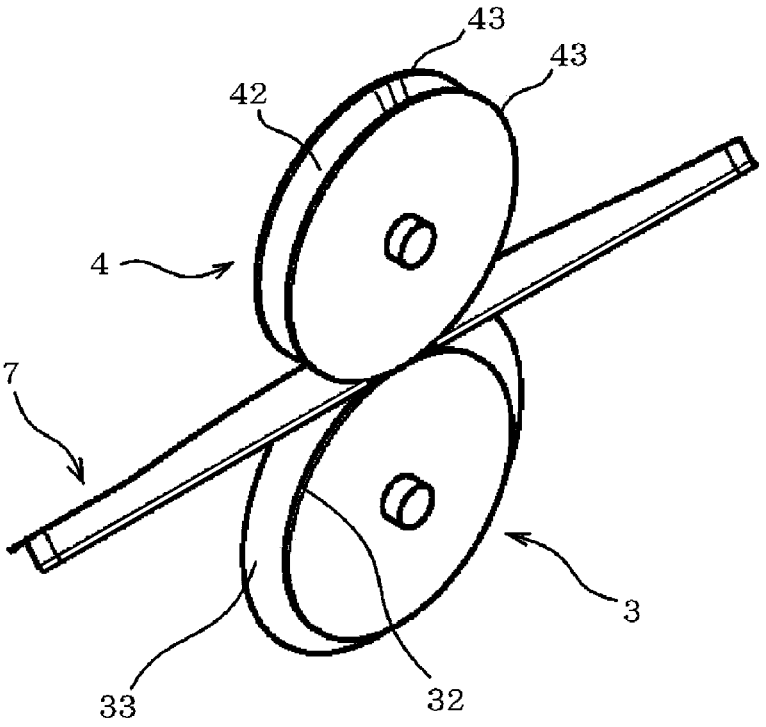
FIG. 25B is a perspective view of rolling dies according to a 10th embodiment which is shown together with the shaped steel of FIG. 25A.

The present embodiment produces a shaped steel which forms a cross-sectional V-shape. FIG. 25A shows a V-shaped steel 7 with a width in cross-sectional shape which is constant and a height which varies, while FIG. 25B shows the top and bottom rolls 4 and 3 of the final station for the V-shaped steel 7 which is shown in FIG. 30A. More specifically, the V-shaped steel 7 of the present embodiment has a heightening portion 71*a* with a constant width and a lowering portion 71*b* with a constant width. The annular ridge part of the bottom roll 3 has a cross-sectional outer shape of a triangular shape (V-shape) and an expanding outside diameter in the circumferential direction in the range of 0° to 180° and decreasing outside diameter in the range of 180° to 360°. The recessed part of the top roll 4 which faces the bottom roll 3 also becomes a triangular shape (V-shape) which varies in height in the circumferential direction. The roll unit which drives rotation of the top and bottom rolls 4 and 3 can be configured in overall structure in the same way as in the first embodiment. In this case as well, by simple control for making the top and bottom rolls 4 and 3 rotate synchronized, a V-shaped steel 7 which varies in height in cross-sectional shape in the longitudinal direction can be produced.

11th Embodiment

Figure 26A:
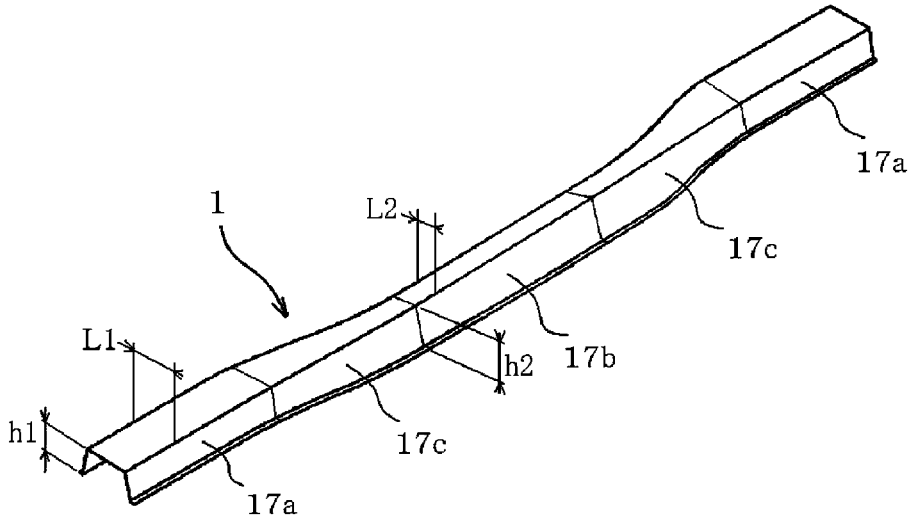
FIG. 26A is a perspective view of a shaped steel according to an 11th embodiment.
Figure 26B:
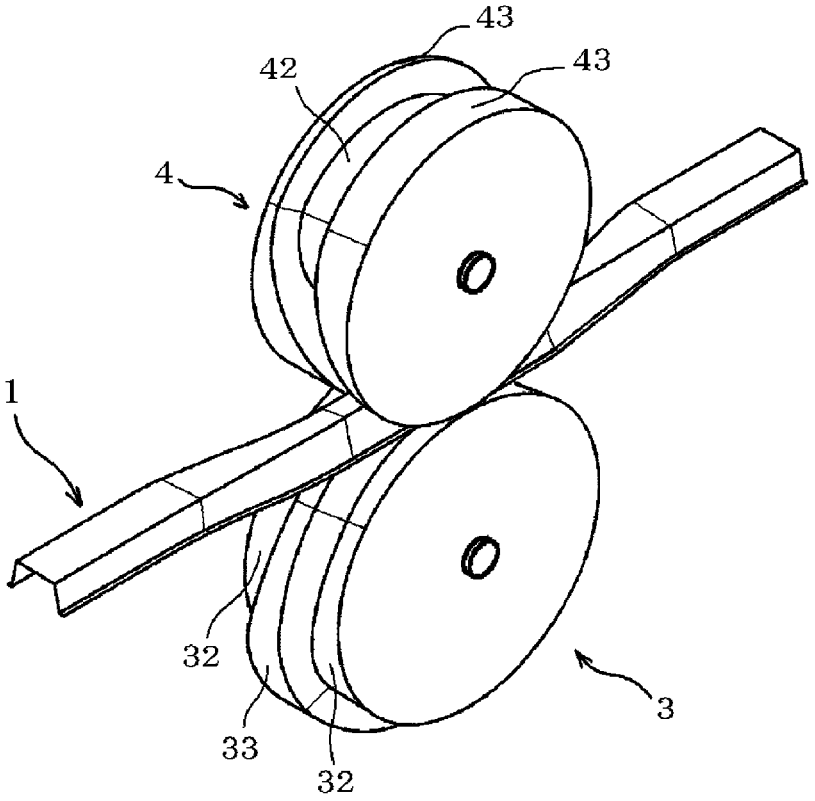
FIG. 26B is a perspective view of rolling dies according to an 11th embodiment which is shown together with the shaped steel of FIG. 26A.

FIG. 26A shows a hat-shaped steel 1 which varies in both width and height of cross-sectional shape, while FIG. 26B shows the top and bottom rolls 4 and 3 of the final station for the shape of the hat-shaped steel 1 which is shown in FIG. 26A. More specifically, the hat-shaped steel 1 of the present embodiment has a portion 17*a* of a cross-sectional shape width L1 and height h1, a portion 17*b* of a cross-sectional shape width L2 and height h2, and a portion 17*c* of a changing width L1 to L2 and height h1 to h2. For this reason, the annular ridge part and annular groove part of the top and bottom rolls 4 and 3 are made shapes which vary in both height and width of cross-sectional shape in the circumferential direction (L1→L2→L1, h1→h2→h1). The overall structure of the roll unit which drives rotation of the top and bottom rolls 4 and 3 can be configured in the same way as in the first embodiment. In this case as well, by simple control for making the top and bottom rolls 4 and 3 rotate synchronized, a hat-shaped steel 1 which varies in both width and height in cross-sectional shape can be produced.

Above, the present invention was explained in detail with reference to specific embodiments, but various substitutions, alterations, changes, etc. relating to the format or details are possible without departing from the spirit and scope of the invention such as defined by the language in the claims will be clear to a person having ordinary skill in the technical field. Therefore, the scope of the present invention is not limited to the above-mentioned embodiment and attached figures and should be determined based on the description of the claims and equivalents to the same.

REFERENCE NOTATIONS LIST 1 hat-shaped steel
2 multistage roll forming apparatus
3 bottom roll
32 flank part
33 annular ridge part
4 top roll
42 annular groove part
43 flank part

The invention claimed is:

1. A method of producing a shaped steel which varies in cross-sectional shape in a longitudinal direction from a sheet by roll forming, comprising:

a step of preparing a first rolling die which has a rotation shaft and an annular ridge part which varies in cross-sectional shape in a circumferential direction which is centered about said rotation shaft;

a step of arranging said first rolling die so that the rotation shaft of said first rolling die becomes perpendicular to a sheet feed direction;

a step of preparing a second rolling die which has a rotation shaft and an annular groove part which varies in cross-sectional shape in a circumferential direction which is centered about said rotation shaft;

a step of arranging said second rolling die so that a gap which is equal to a thickness of said sheet is formed between said first rolling die and second rolling die and the annular ridge part of said first rolling die and the annular groove part of said second rolling die engage;

a step of making said first rolling die and said second rolling die rotate synchronized; and a step of feeding the sheet between said first rolling die and second rolling die, wherein side surfaces of the annular ridge part of said first rolling die are provided with a relief so that the gap with respect to side surfaces of the annular groove part of the second rolling die broadens inward in a radial direction throughout the circumference.

2. The method of production of a shaped steel according to claim 1, wherein a width measured in the rotation shaft direction of each of said annular ridge part of the first rolling die and said annular groove part of the second rolling die varies in the circumferential direction.

3. The method of production of a shaped steel according to claim 2, wherein each of said annular ridge part of said first rolling die and said annular groove part of said second rolling die is configured so that a height which is measured in a perpendicular direction with respect to said rotation shaft varies in the circumferential direction.

4. The method of production of a shaped steel according to claim 2, wherein said shaped steel is a hat-shaped steel with an inner circumferential surface which is rolled by the annular ridge part of the first rolling die and with an outer circumferential surface which is rolled by the annular groove part of the second rolling die.

5. The method of production of a shaped steel according to claim 2, wherein the annular ridge part of said first rolling die includes, in its circumferential direction, a first roll width region, a second roll width region, and a tapered region which increases or decreases in width from said first roll width to second roll width.

6. The method of production of a shaped steel according to claim 2, wherein said annular ridge part is offset in the rotation shaft direction in its circumferential direction and said first rolling die produces a shaped steel having stock axis which is curved in the width direction.

7. The method of production of a shaped steel according to claim 1, wherein each of said annular ridge part of said first rolling die and said annular groove part of said second rolling die is configured so that a height which is measured in a perpendicular direction with respect to said rotation shaft varies in the circumferential direction.

8. The method of production of a shaped steel according to claim 7, wherein said shaped steel is a hat-shaped steel with an inner circumferential surface which is rolled by the annular ridge part of the first rolling die and with an outer circumferential surface which is rolled by the annular groove part of the second rolling die.

9. The method of production of a shaped steel according to claim 7, wherein the annular ridge part of said first rolling die includes, in its circumferential direction, a first roll width region, a second roll width region, and a tapered region which increases or decreases in width from said first roll width to second roll width.

10. The method of production of a shaped steel according to claim 7, wherein said annular ridge part is offset in the rotation shaft direction in its circumferential direction and said first rolling die produces a shaped steel having stock axis which is curved in the width direction.

11. The method of production of a shaped steel according to claim 1, wherein said shaped steel is a hat-shaped steel with an inner circumferential surface which is rolled by the annular ridge part of the first rolling die and with an outer circumferential surface which is rolled by the annular groove part of the second rolling die.

12. The method of production of a shaped steel according to claim 11, wherein the annular ridge part of said first rolling die includes, in its circumferential direction, a first roll width region, a second roll width region, and a tapered region which increases or decreases in width from said first roll width to second roll width.

13. The method of production of a shaped steel according to claim 11, wherein said annular ridge part is offset in the rotation shaft direction in its circumferential direction and said first rolling die produces a shaped steel having stock axis which is curved in the width direction.

14. The method of production of a shaped steel according to claim 1, wherein the annular ridge part of said first rolling die includes, in its circumferential direction, a first roll width region, a second roll width region, and a tapered region which increases or decreases in width from said first roll width to second roll width.

15. The method of production of a shaped steel according to claim 1, wherein said annular ridge part is offset in the rotation shaft direction in its circumferential direction and said first rolling die produces a shaped steel having stock axis which is curved in the width direction.

16. The method of production of a shaped steel according to claim 15, wherein an outside diameter of the annular ridge part of said first rolling die and an outside diameter of a bottom surface part of the grooved part of the second rolling die are the same.

17. The method of production of a shaped steel according to claim 1, wherein a relief amount x of the side surfaces of said first rolling die is set to not less than a value which is calculated by the equation: $x=\alpha \times H \times \tan\theta$ wherein $\alpha$ is a constant determined based on a roll shape, where a height of the annular ridge part is "H", an angle of the side walls of the shaped steel is "$\theta$" wherein $\theta$ is less than 85°.

18. The method of production of a shaped steel according to claim 17, wherein a plurality of roll units each of which comprises a first rolling die and a second rolling die are arranged in series in a sheet feed direction and the sheet is bent by these plurality of roll units so that the side wall angle $\theta$, wherein $\theta$ is less than 85°, is increased in stages, and in that the relief amount x of the side surfaces of the first rolling die of part or all of the roll units is not less than a value which is calculated by the equation: $x=\alpha \times H \times \tan\theta$.

19. The method of production of a shaped steel according to claim 1, wherein the sheet is ultra high tensile steel.

20. A roll forming apparatus for roll forming for producing a shaped steel which varies in cross-sectional shape in a longitudinal direction from a sheet, comprising:

a first rolling die which has a rotation shaft and an annular ridge part which varies in cross-sectional shape in a circumferential direction which is centered about said rotation shaft, said first rolling die arranged so that the rotation shaft of said first rolling die becomes perpendicular to a sheet feed direction;

a second rolling die which has a rotation shaft and an annular groove part which varies in cross-sectional shape in a circumferential direction which is centered about said rotation shaft, said second rolling die arranged so that said rotation shaft of said second rolling die becomes parallel to said rotation shaft of said first rolling die; and a drive device which synchronizes and rotationally drives said first rolling die and said second rolling die, wherein said first rolling die and second rolling die are arranged relatively so that a gap which is equal to a thickness of said sheet is formed between the two and the annular ridge part of said first rolling die and the annular groove part of said second rolling die engage, wherein side surfaces of the annular ridge part of said first rolling die are provided with a relief so that the gap with respect to side surfaces of the annular groove part of the second rolling die broadens inward in a radial direction throughout the circumference.

* * * * *